US006822582B2

(12) United States Patent
Voeller et al.

(10) Patent No.: US 6,822,582 B2
(45) Date of Patent: Nov. 23, 2004

(54) RADIO FREQUENCY IDENTIFICATION AUTOMOTIVE SERVICE SYSTEMS

(75) Inventors: David Voeller, St. Louis, MO (US); Joel Clasquin, Edwardsville, IL (US)

(73) Assignee: Hunter Engineering Company, Bridgeton, MO (US)

( * ) Notice: Subject to any disclaimer, the term of this patent is extended or adjusted under 35 U.S.C. 154(b) by 86 days.

(21) Appl. No.: 10/374,962

(22) Filed: Feb. 25, 2003

(65) Prior Publication Data

US 2004/0164140 A1 Aug. 26, 2004

(51) Int. Cl.[7] ..... G08G 1/01

(52) U.S. Cl. ..... 340/933; 340/10.4; 340/10.42; 701/32; 701/35

(58) Field of Search ..... 340/933, 572.1, 340/10.1, 10.42; 701/29, 32, 35; 280/86.75

(56) References Cited

U.S. PATENT DOCUMENTS

| | | | | |
|---|---|---|---|---|
| 5,058,044 A | * | 10/1991 | Stewart et al. | 702/184 |
| 5,884,202 A | * | 3/1999 | Arjomand | 701/29 |
| 5,950,144 A | * | 9/1999 | Hall et al. | 702/108 |
| 6,442,460 B1 | * | 8/2002 | Larson et al. | 701/33 |
| 6,587,768 B2 | * | 7/2003 | Chene et al. | 701/33 |
| 2002/0070862 A1 | | 6/2002 | Francis et al. | |
| 2002/0089434 A1 | | 7/2002 | Ghazarian | |
| 2002/0092345 A1 | | 7/2002 | VanNiekerk et al. | |
| 2002/0092347 A1 | | 7/2002 | VanNiekerk et al. | |

OTHER PUBLICATIONS (Full Color Booklet) "Series 611—Computerized Wheel Alignment System" Hunter Engineering Company—Copyright 2001.

(Full Ciolor Booklet) "GSP9700—Vibration Control System" Hunter Engineering Company—Copyright 2001.

(Full Color Booklet) "B400 Brake Tester—Computerized Inspection Lane Module with WinSl Software" Hunter Engineering Company—Copyright 2001.

(Full Color Brochure) "TC3500 Tire Changer—The World Standard in Performance Wheel and Tire Handling" Hunger Engineering Company—Copyright 2003.

(Black & White Booklet) "Application Standard For RFID In The Automotive Industry" Automotive Industry Action Group—Issue 01, Dated Oct. 1991.

(Black & White Booklet) "Tire And Wheel Label And Radio Frequency Identification (RFID) Standard" Automotive Industry Action Group—Issue 04, Dated Oct. 2002.

(Black & White Booklet) "A guide to Radio Frequency Identification technologies and applications"—By Prof. Anthony Furness, with Foreword by Alan L. Haberman, Chair, ISO/IEC JTC1 SC31—From the publishers of RF innovations.

(Black & White Booklet) "Electronic Surveillance Packaging"—An Outline of the State if the Industry—IoPP Electronic Surveillance Packaging Committee —Institute of Packaging Professionals—Copyright 1997.

(List continued on next page.)

*Primary Examiner*—Toan N. Pham
(74) *Attorney, Agent, or Firm*—Polster, Lieder, Woodruff & Lucchesi

(57) ABSTRACT

An improved automotive vehicle service system incorporating an RFID interrogator to exchange data with one or more RFID transponders or tags associated with a vehicle undergoing service, or with a component of a vehicle undergoing service. The automotive vehicle service system is configured to utilize data received through the RFID interrogator from the RFID transponders or tags during a vehicle service procedure. Optionally, the automotive vehicle service system is configured to store data associated with a vehicle service procedure in an RFID transponder or tag associated with a vehicle undergoing service, or with a component of a vehicle undergoing service.

38 Claims, 12 Drawing Sheets

OTHER PUBLICATIONS (Black & White Pamphlet) "The Detroit News has a gift . . . " Tires with metallic tags could help track defects—Sep. 4, 2001, by Ed Garsten / Associated Press—Jun. 17, 2002.

(Black & White Pamphlet) AIAG Project Update AIAG CQI–4 Informantion Kit for QS–9000/TQM tools correlation . . . AIAG Managed Data Identifiers per ANSIK MH10.8.2 Draft—5 pages.

(Black & White Pamphlet) NEWS for Immediate Release—Sharon Schwank/AIAG–"AIAG Work Group Develops Standard to Identify and Track Vehicle Tires"—Jun. 17, 2002—2 pages.

* cited by examiner

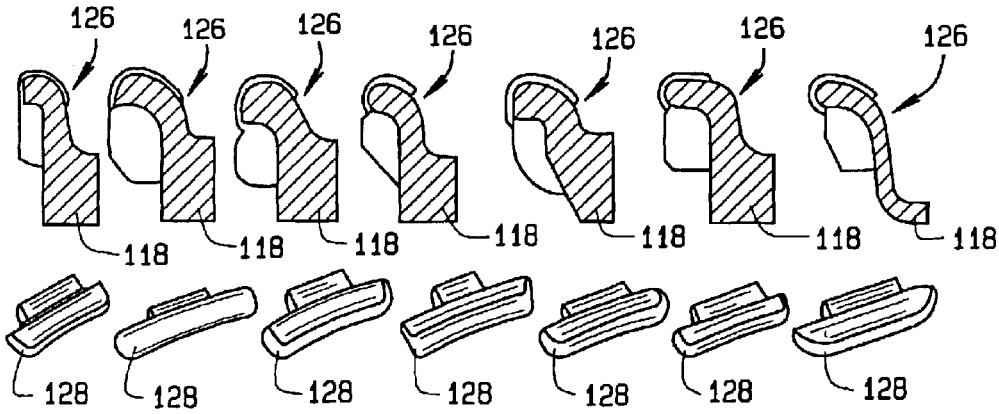
FIG. 9
PRIOR ART
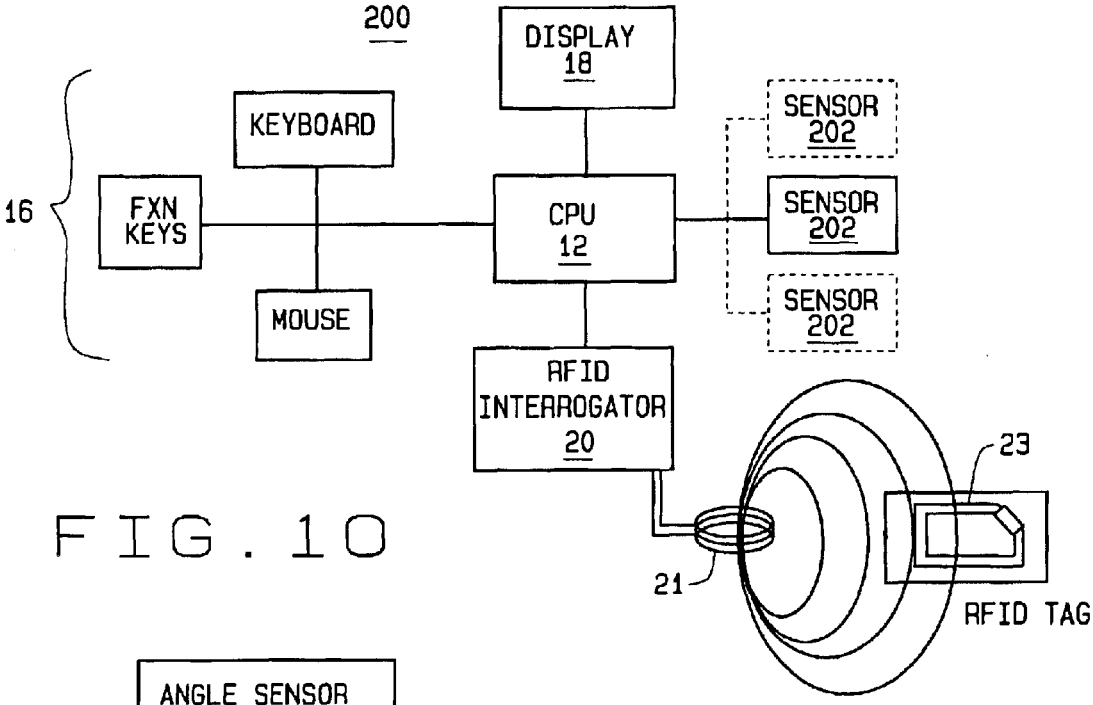
FIG. 10
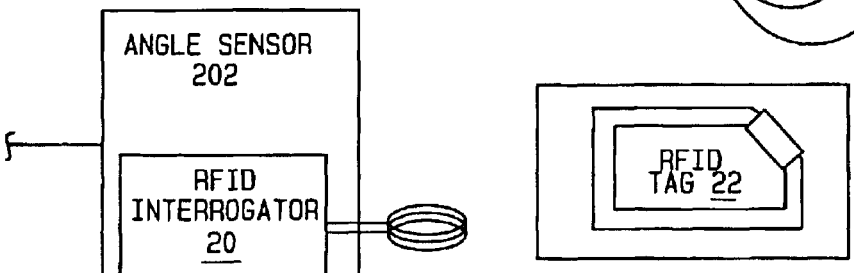
FI . 11

RADIO FREQUENCY IDENTIFICATION AUTOMOTIVE SERVICE SYSTEMS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates generally to automotive vehicle service systems such as vehicle wheel alignment systems, vehicle wheel balancers, and vehicle tire changers which require the input of information related to a vehicle undergoing a service or a component on the vehicle, and in particular, to automotive service systems utilizing Radio Frequency Identification (RFID) technology to directly obtain information relating to a vehicle undergoing service, or relating to a component on the vehicle, from an non-contact link embedded data storage device.

In automotive vehicle service systems and in an automotive vehicle service environments, it is routinely necessary for an operator to provide the vehicle service system with information pertaining to a vehicle undergoing service, or to a component on the vehicle, prior to or during a vehicle service procedure. Information provided to an automotive vehicle service system optionally is input manually by an operator following a visual inspection of the vehicle or component, or optionally is measured or observed by the automotive service system at the direction of an operator.

For example, an operator optionally is required to identify input vehicle make, model, and year information to a vehicle wheel alignment system, or a measurement of a vehicle wheel rim diameter is taken using a measurement arm associated with a vehicle wheel balancer system. In a vehicle wheel alignment system, an operator may be required to remove a vehicle wheel to identify the type and configuration of an installed wheel alignment adjustment component, such as a shim or bushing, or a measurement optionally is taken of the alignment effect of an installed suspension component. Similarly, an operator of a vehicle tire changer system must identify the presence of remote tire pressure sensors installed inside a vehicle wheel assembly before dismounting a tire from the wheel rim, to avoid damaging the sensors.

Traditionally, a limited amount of information related to a vehicle or component might be stored in a marking on the vehicle or component such as a machine-readable bar code which can typically hold 1 to 100 bytes of information. For example, a vehicle identification number (VIN) is often encoded in machine readable bar-code adjacent the vehicle's windshield, permitting rapid scanning and collection of the standardized information contained therein. Product parts numbers, lot number, and manufacture dates may also be stored in alpha-numeric markings or bar codes affixed to removable products, such as vehicle tires, alignment adjustment shims, suspension bushings, etc. indications of the presence of a remote tire pressure sensor within a wheel assembly may be made by affixing a sticker or indicator mark to the wheel assembly. While providing storage for information, the use of alpha-numeric markings, indictors, or bar codes does not permit the stored information to be updated or changed, without replacing the original markings with new or altered markings. Traditional markings are also limited in the amount of information that can be stored. An additional drawback to traditional markings, indicators, and bar codes is a susceptibility to damage, loss, or degradation due to environmental exposures such as mud, road salt, and lubricants.

One alternative to alpha-numeric or bar code markings on automotive products and components are Radio Frequency Identification (RFID) transponders or tags, which are a form of Automatic Identification and Date Capture (AIDC) technology, sometimes referred to as Automatic Data Capture (ADC) technology. The essence of RFID technology is the ability to carry data in a suitable carrier and recover that data (read) or modify (write) it when required through a non-contact electromagnetic communications processe across what is essentially an air interface.

RFID utilizes wireless radio communications to uniquely identify objects by communicating with an RFID transponder or tag 3 associated with the object and programmed with unique identifying data related to an object or component. One type of RFID transponder or tag 3, shown in FIG. 1, consists of a logic circuit 5, a semiconductor memory 7, and a radio-frequency antenna 9 configured to receive and transmit data. Numerous types and configurations of RFID transponders or tags 3 are known.

As represented in FIG. 2A, data stored in the memory of the RFID transponder or tag 3 optionally is read or modified remotely over a wireless radio communications link, i.e. an air interface, to the RFID transponder or tag 3, thereby providing features and capabilities not present with traditional bar code data storage. An RFID interrogator containing a radio frequency transmitter-receiver unit used to query an RFID transponder or tag, at an operating frequency in the range between 30 KHz to 25 GHz, and preferably in the UHF (ultra high frequency) range of 869 MHz to 928 MHz, or at 2450 MHz. The RFID interrogator optionally is disposed at a distance from the RFID transponder or tag, and moving relative thereto. The RFID transponder or tag detects the interrogating signal and transmits a response signal preferably containing encoded data stored in the semiconductor memory back to the interrogator. Such RFID transponders or tags may have a memory capacity of 16 bytes to more than 64 kilobytes, which is substantially greater than the maximum amount of data conventionally contained in a bar code marking or other type of human-readable indicia. In addition, the data stored in the RFID transponder or tag semiconductor memory optionally is re-written with new data or supplemented additional data transmitted from the RFID interrogator.

As shown in FIG. 2B, power for the data storage and logic circuits optionally is derived from an interrogating radio-frequency (RF) beam or from another power source. Power for the transmission of data can also be derived from the RF beam or taken from another power source. As described in U.S. Pat. No. 6,107,910 to Nysen, and in the publication "Understanding RFID" by Prof. Anthony Furness, a variety of RFID transponders or tags are known, such as surface acoustic wave devices, all of which provide data storage and retrieval capabilities.

One benefit of an RFID transponder or tag over an alpha-numeric marking or bar code is the use of a non-contact data link which does not require a line-of-sight between an RFID interrogator and the RFID transponder or tag. Concerns about harsh or dirty environmental conditions, such as are commonly found in automotive service environments, which restrict the use of bar codes or may obscure and degrade other markings on a product or vehicle, are not a concern with RFID transponders or tags.

An industry group referred to as the Automotive Industry Action Group (AIAG) has been working with a large number of companies to develop a standard for identifying vehicle tires in the automotive original equipment manufacturer (OEM) environment. One result from this group has been the development of the AIAG B-11 Tire and Wheel Label and RFID Standard, herein incorporated by reference, for read/write RFID tags installed in vehicle tires. The B-11 Standard is designed to help automate the collection of tire and wheel information and to facilitate the mounting and assembly process of tires and wheels with vehicles in the OEM production environment. The B-11 Standard sets forth data fields for use in an tire and wheel RFID transponder or tag which may include tire conicity, tire radial force data, tire imbalance data, tire serial number, and other tire related data or dimensions.

Accordingly, it would be desirable to provide an aftermarket vehicle service system with the ability to interact directly with data stored in suitable RFID carriers associated with an automotive vehicle or vehicle component, such as a tire, via a noncontact electromagnetic communications processes across an air interface, and to utilize the stored data in one or more aftermarket vehicle service procedures.

BRIEF SUMMARY OF THE INVENTION

Briefly stated, the present invention comprises an improved automotive vehicle service system incorporating an RFID interrogator to exchange data with one or more RFID transponders or tags associated with a vehicle undergoing service, or with a component of a vehicle undergoing service. The automotive vehicle service system is configured to utilize data received through the RFID interrogator from the RFID transponders or tags during a vehicle service procedure.

In an alternate embodiment, the automotive vehicle service system is further configured to store data associated with a vehicle service procedure in an RFID transponder or tag associated with a vehicle undergoing service, or with a component of a vehicle undergoing service.

In an alternate embodiment, the automotive vehicle service system is a vehicle wheel balancer, configured to utilize tire parameters stored in an RFID transponder or tag associated with a vehicle tire during the balancing of a vehicle wheel assembly consisting of the tire and a rim. The stored tire parameters are retrieved from the tire RFID transponder or tag via a RFID interrogator associated with the vehicle wheel balancer system. Optionally, updated tire balance parameters are communicated to the RFID transponder or tag for storage from the vehicle wheel balance through the associated RFID interrogator.

In an alternate embodiment, the automotive vehicle service system is a vehicle wheel alignment system, configured to utilize alignment parameters, vehicle information, and component information stored in an RFID transponder or tag associated with a vehicle during alignment of the vehicle wheels. The stored alignment parameters are retrieved from the vehicle RFID transponder or tag via a RFID interrogator associated with the vehicle wheel alignment system. Optionally, updated alignment information is communicated to the RFID transponder or tag for storage from the vehicle wheel alignment system through the associated RFID interrogator.

In an alternate embodiment, the automotive vehicle service system is a vehicle wheel alignment system, configured to utilize alignment parameters, vehicle information, or component information stored in RFID transponders or tags associated with a vehicle, or with alignment, steering, or suspension components during alignment of the vehicle wheels. The stored alignment parameters are retrieved from the component RFID transponders or tags via RFID interrogators associated with individual alignment sensor unit of the vehicle wheel alignment system. Optionally, updated alignment information is communicated to the RFID transponders or tags for storage from the vehicle wheel alignment system through the associated RFID interrogator.

In an alternate embodiment, the automotive vehicle service system is a vehicle wheel tire changer system, configured to utilize tire and wheel parameters stored in an RFID transponder or tag associated with a tire or wheel during mounting or dismounting of a tire from a wheel rim. The stored tire or wheel parameters are retrieved from the tire or wheel RFID transponders or tags via a RFID interrogator associated with the vehicle wheel tire changer system. Optionally, updated tire or wheel information is communicated to the RFID transponders or tags for storage from the vehicle wheel tire changer system through the associated RFID interrogator.

In an alternate embodiment, the automotive vehicle service system is a vehicle brake testing system, configured to utilize vehicle parameters stored in an RFID transponder or tag associated with a vehicle undergoing brake testing. The stored vehicle parameters are retrieved from the vehicle RFID transponders or tags via a RFID interrogator associated with the brake testing system. Optionally, updated vehicle information is communicated to the RFID transponders or tags for storage from the vehicle brake testing system through the associated RFID interrogator.

In an alternate embodiment, the automotive vehicle service system is a vehicle inspection system, configured to utilize vehicle component parameters stored in an RFID transponder or tag associated with a component of the vehicle undergoing inspection. The stored vehicle component parameters are retrieved from the component RFID transponders or tags via a RFID interrogator associated with the inspection system. Optionally, updated vehicle component information is communicated to the RFID transponders or tags for storage from the vehicle inspection system through the associated RFID interrogator.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification:

FIG. 9 is an illustration of conventional balance correction weight types and associated balance weight flanges;

FIG. 10 is a block diagram view of the components on an vehicle wheel alignment system of the present invention;

FIG. 11 is a partial block diagram of an optional configuration for the vehicle wheel alignment system of FIG. 11;

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
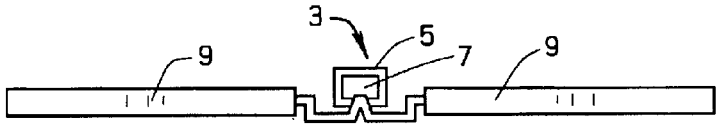
FIG. 1 PRIOR ART
FIG. 1 is a view on one type of prior art RFID transponder or tag.
Figure 3:
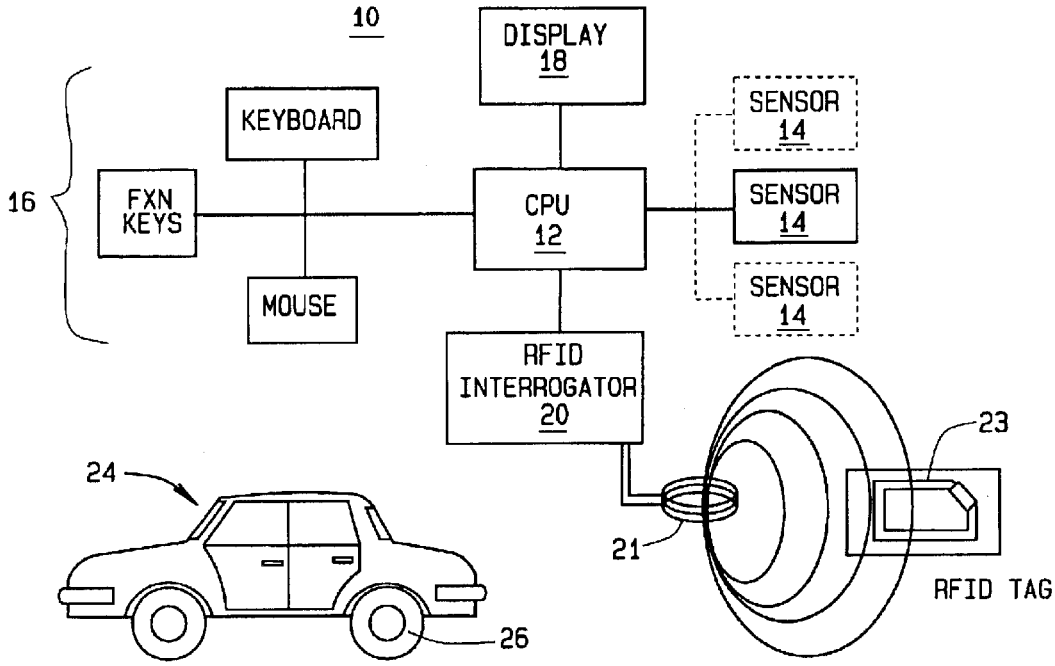
FIG. 3 is a block diagram view of the components on an automotive service system of the present invention.
Figure 2A:
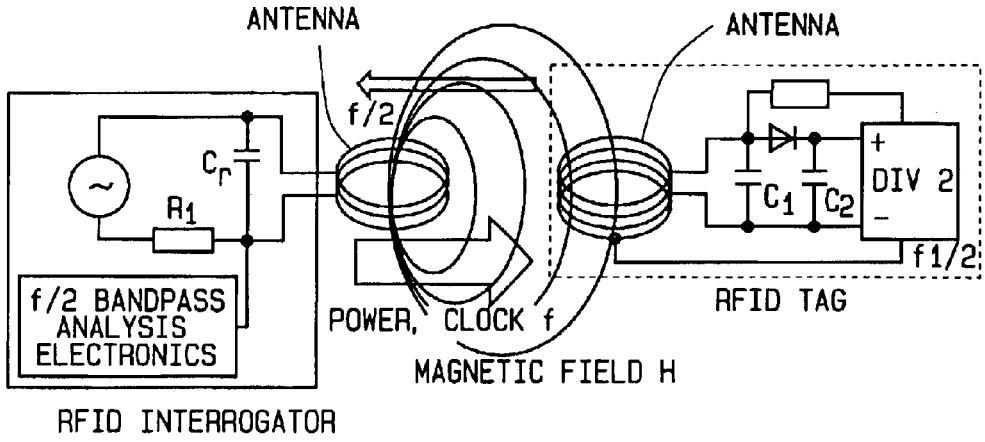
FIG. 2A PRIOR ART
FIG. 2A is a representation of a prior art RFID interrogator data exchange with an RFID transponder or tag.
Figure 2B:
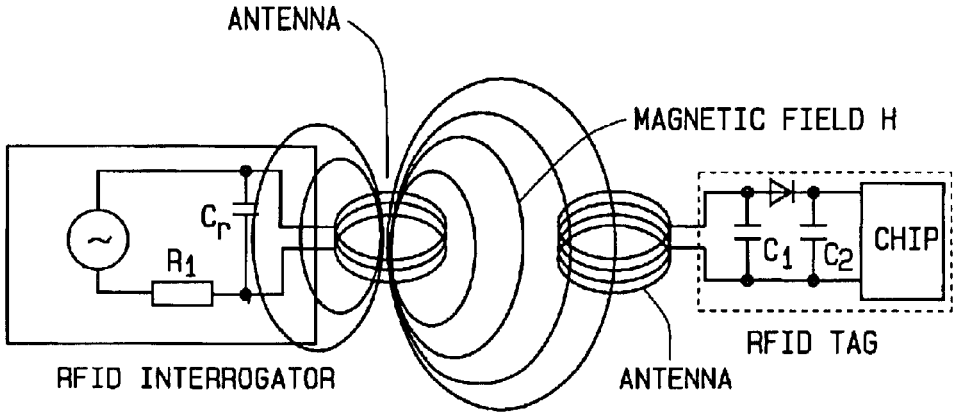
FIG. 2B PRIOR ART
FIG. 2B is a representation of a prior art RFID interrogator power transfer to an RFID transponder or tag.

Turning to FIG. 3, an improved automotive vehicle service system of the present invention is shown generally at 10. The vehicle service system 10 includes at least one computer 12 configured with an operating system and at least one vehicle service software application adapted to carry out one or more specific vehicle service functions. The computer 12 is preferably a general purpose computer, but optionally is any computing device used with systems of complexity similar to that of a automotive vehicle service system. For example, a micro-processor, a micro-controller, graphics signal processor, or a digital signal processor having sufficient computing power.

Coupled to the computer 12 are one or more vehicle service devices or sensors 14 utilized to carry out the one or more specific vehicle service functions for which the vehicle service system 10 is adapted, as well as one or more conventional data input devices 16, such as a mouse, a keyboard, or input buttons. Preferably, one or more visual display devices 18 are coupled to the computer 12 to provide an operator with a display of visual information. A visual display device 18 optionally is an LED readout configured to display alpha-numeric information, a liquid crystal display (LCD), a cathode-ray tube (CRT) display, or any other conventional visual display device. Optionally, the visual display device 18 optionally is configured with a touch-screen interface, to present the operator with a graphical user interface to the operating system and vehicle service software application operating on the computer 12. Those of ordinary skill in the art will recognize that additional standard components optionally are operatively coupled to the computer 12, such as, but not limited to, data storage devices, printers, and communication interfaces (i.e. local area networks, Internet connections, 802.11 transceiver, Bluetooth transceiver, Infrared port, USB port, 1394 FireWire), within the scope of the present invention.

Operatively coupled to the computer 12 for exchanging data therewith is at least one RFID interrogator 20, having a reader/antenna 21, and configured to exchange data over a wireless communications link with one or more RFID transponders or tags 22, each having an antenna coil 23, and associated with a vehicle 24 undergoing service, or with a component 26 of a vehicle undergoing service. The RFID interrogator 20 is preferably disposed in operative proximity to the RFID transponders or tags 22 associated with the vehicle 24 or the component 26, and operatively coupled to the computer 12 via a conventional cable connection. However, the RFID interrogator 20 may optionally be disposed in a handheld or portable unit suitable for an operator to move around a vehicle 24, and/or configured to exchange data to the computer 12 via a conventional wireless communications link, such as an infrared or radio-frequency data link.

Each RFID transponder or tag 22 advantageously requires no self-contained battery for operation. Instead, the RFID transponder or tag 22 obtains operating power from the radio frequency (RF) or electromagnetically coupled RFID interrogator 20 when in proximity thereto. It will be recognized by those of ordinary skill in the art that the format of the data stored in the RFID transponders or tags 22 optionally is either in an industry standard format, such as the AIAG B-11 standard, or optionally is a predetermined proprietary format understood by a software application associated with the computer 12.

The computer 12 is configured with a software application to either communicate with or to control the RFID interrogator 20, and to extract stored data from the RFID transponders or tags 22 prior to, or during, a vehicle service procedure over the electromagnetic coupling or wireless communications link between the RFID interrogator antenna 21 and the RFID transponder or tag antenna coil 23. The vehicle service software application operating on the computer 12 is configured to utilize the extracted data to facilitate the completion of one or more vehicle service procedures.

The following examples are illustrative of some of the general types of information which the improved automotive vehicle service system 10 may retrieve from an RFID transponder or tag 22. These examples are not intended as limiting, and those of ordinary skill in the art will recognize that numerous types of data useful in vehicle service procedures optionally are stored and retrieved from an RFID transponder or tag 22 associated with a vehicle 24 or vehicle component 26. Stored data optionally is representative of predetermined parameters (such as make, model, year, part number, etc.) or actual parameters (factory measured values) of a vehicle or component. Stored data may further be representative of historical information, such as previous repair data, vehicle mileage or wear data, component installation data, or service history.

In an alternate embodiment, the automotive vehicle service system 10 is further configured to store data associated with a vehicle service procedure in an RFID transponder or tag 22 associated with a vehicle 24 undergoing service, or with a component 26 of a vehicle undergoing service. The vehicle service software application operating in the computer 12 is configured to convey data to be stored in the RFID transponder or tag 22 to the RFID interrogator 20 coupled to the computer 12. The data to be stored is then communicated from the RFID interrogator antenna 21 to the RFID transponder or tag antenna 23 over a wireless communications link, and subsequently stored in a memory of the RFID transponder or tag 22. The data to be stored may include, but is not limited to, results of a service procedure, service center information, or updated parameters such as component wear or location, measured parameters, vehicle mileage, or chronological information such as the date and time of a vehicle service or inspection.

Figure 4:
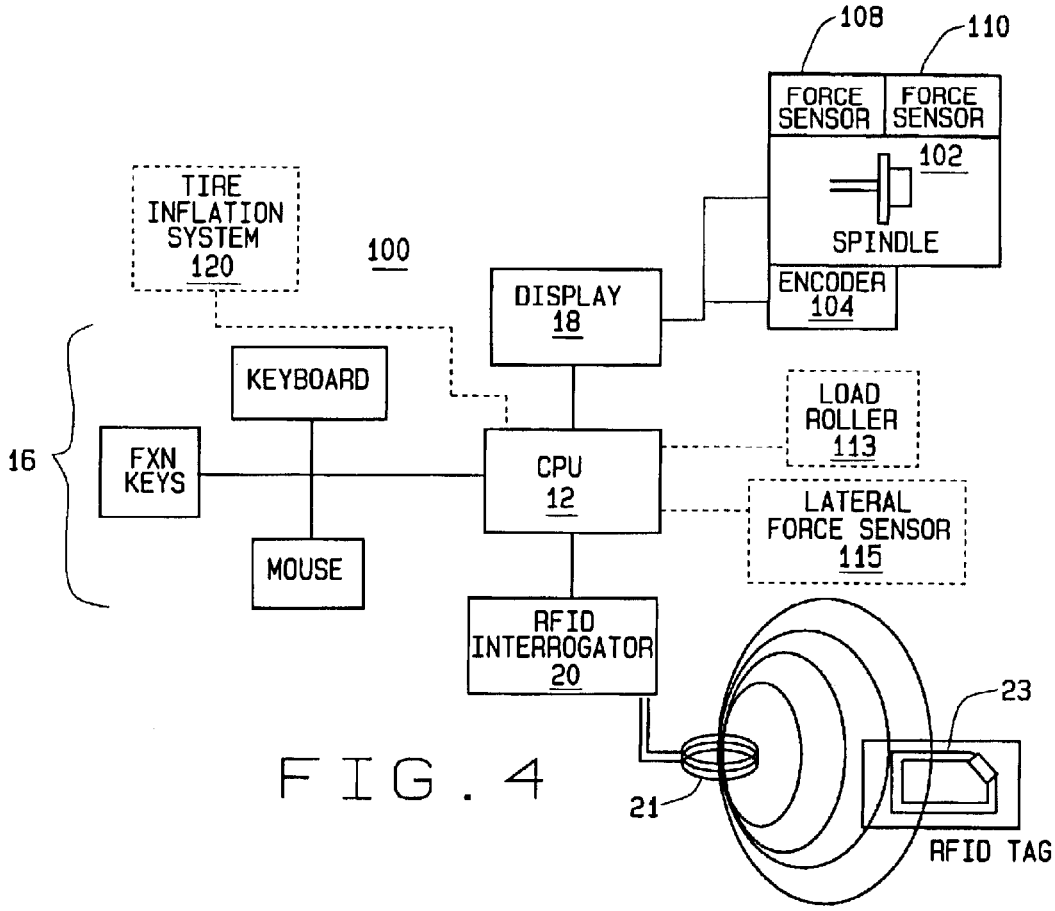
FIG. 4 is a block diagram view of the components on an vehicle wheel balancer system of the present invention.

In an alternate embodiment show in FIG. 4, the improved automotive vehicle service system 10 of the present invention is configured as a vehicle wheel balancer system 100 with a rotatable shaft or spindle 102 driven by a suitable drive mechanism. Mounted on the spindle 102 is a conventional shaft encoder 104 which provides speed and rotational position information to the computer 12. To measure vehicle wheel imbalance of a vehicle wheel assembly, wheel rim, or tire under test which is removably mounted for rotation on the spindle 102, the balancer system 100 includes at least a pair of force sensors 108 and 110, such as piezoelectric or other suitable strain gauges, mounted on a balancer base 112 and operatively positioned to observe forces generated by the spindle 102. Signals representative of the observed forces are communicated from the force sensors 108 and 110 to the computer 12 for subsequent processing by a vehicle wheel balancer software application.

Figure 5:
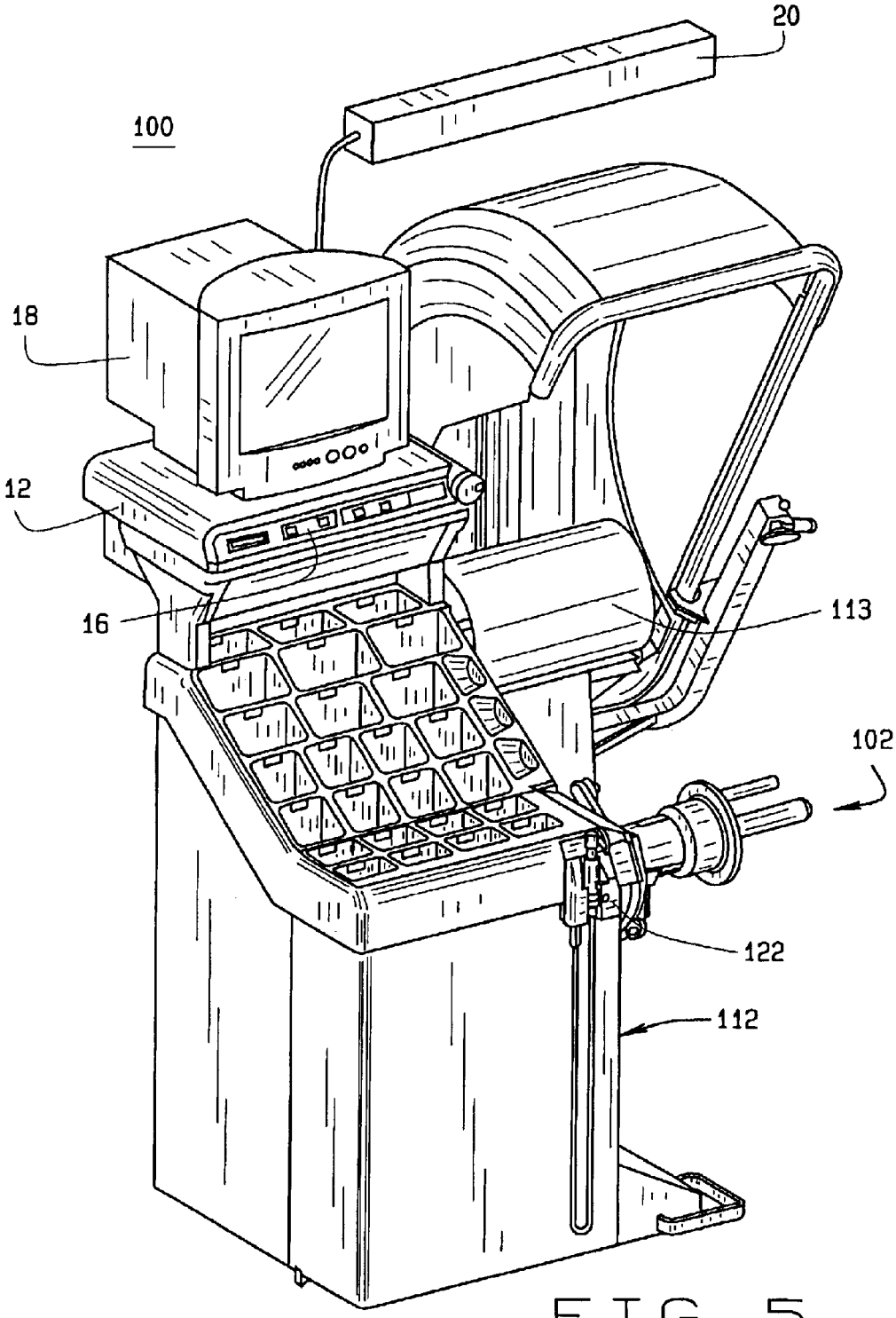
FIG. 5 is a perspective view of a vehicle wheel balancer system of FIG. 4.

The operation of the various components of the balancer system 100 described above, and the balancer system 100 in general, is well known to those of ordinary skill in the wheel balancing field. It should be understood that the above description is included for completeness only, and that the present invention is not limited to use with wheel balancer systems, but can be utilized with various other wheel vibration control systems, including systems 100 such as shown in FIG. 5, configured to measure lateral forces exerted by a rotating wheel, tire, or wheel assembly with a load roller 113 and one or more lateral force sensors 115. An exemplary system 100 is the GSP-9700 wheel vibration control system manufactured and sold by Hunter Engineering Company of Bridgeton, Mo.

Figure 6:
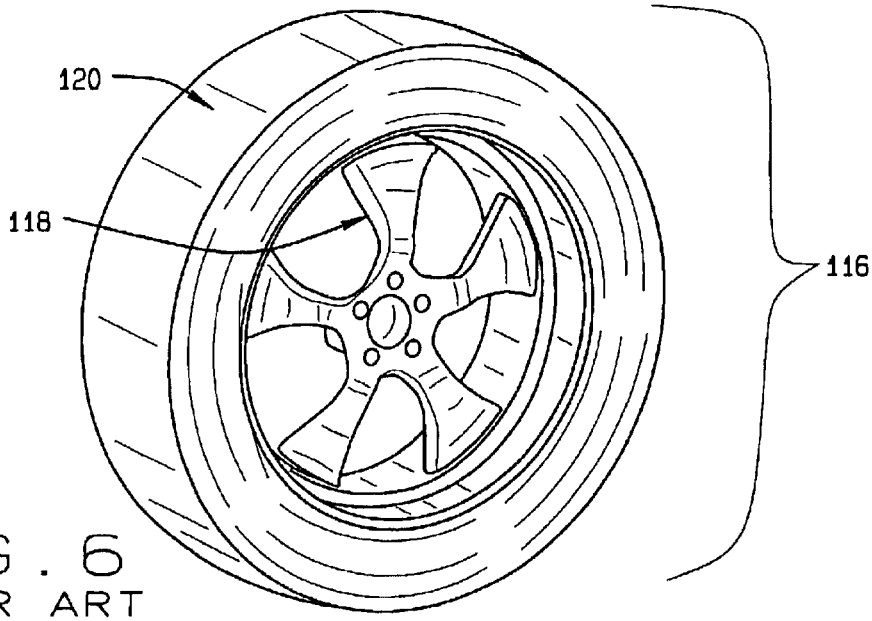
FIG. 6 PRIOR ART
FIG. 6 is a perspective view of a conventional wheel assembly.

Operatively coupled to the computer 12 of the balancer system 100 is at least one RFID interrogator 20, having a reader/antenna 21, and configured to exchange data over a wireless communications link with one or more RFID transponders or tags 22, each having an antenna coil 23, and associated with a component of a conventional wheel assembly 116, such as shown in FIG. 6.

The computer 12 in the balancer system 100 is configured with a software application to communicate with or to control the RFID interrogator 20, and to extract stored data from the RFID transponders or tags 22 prior to, or during, a balancing procedure over the electromagnetic coupling or wireless communications link between the RFID interrogator antenna 21 and each RFID transponder or tag antenna coil 23.

The balancing software application operating on the computer 12 of the balancing system 100 is configured to utilize the extracted data to facilitate the completion of one or more wheel balancing procedures.

Optionally, the RFID interrogator 20 is disposed in a handheld or portable unit suitable for an operator to move around a vehicle repair facility, reading RFID tags from wheel assembly 116 components not mounted on, or in proximity to, the wheel balancer system 100. The handheld RFID interrogator 20 is optionally operatively coupled to the computer 12 via a conventional wireless communications link, such as an infrared or radio-frequency data link. Those of ordinary skill in the art will recognize that a handheld RFID interrogator 20 may be configured to operate autonomously from the computer 12 to obtain data from RFID tags 22, and that data obtained by a handheld RFID interrogator 20 may be communicated to the software application operating on the computer 12 of the balancing system 100 via one or more conventional data exchange mechanisms.

The following examples are illustrative of some of the general types of information which the balancing system 100 may retrieve and utilize from an RFID transponder or tag 22 associated with a wheel assembly 116 during a wheel assembly servicing procedure. These examples are not intended as limiting, and those of ordinary skill in the art will recognize that numerous types of data useful in wheel assembly servicing procedures, such as balancing procedures or wheel force measuring procedures, optionally is stored and retrieved from an RFID transponder or tag 22 associated with a wheel assembly 116, wheel rim 118, or tire 120. Utilization of the various types of stored data by the balancer system 100, as set forth in detail below, is regulated by the one or more software applications with which the computer 12 of the balancer system 100 is configured, and alteration of the software applications to utilize different types of data retrieved from an RFID transponder or tag 22 is considered routine to one of ordinary skill in the art.

Optionally, stored data is representative of AIAG B-11 Standard data fields and data identifiers (DI), such as, but not limited to, lateral force measurements, harmonic force variations, imbalance measurements, conicity measurements, manufacturer information, tire pressure, and tire parameters.

For wheel balancers, an AIAG B-11 Standard RFID tag optionally contains data utilized by the balancer system 100 in selecting a cone size and/or flange plate adapter for mounting the wheel assembly 116 to the balancer spindle 102, determining radial and lateral runout of the wheel rim 118 without measuring the wheel rim 118, determining proper tire inflation pressure, locating adhesive balance correction weights about the wheel rim 118, determining the correct clip-on balance correction weight type, locating balance correction weight planes, locating the wheel assembly valve stem, verifying tire radial and lateral forces, the facilitation of the identification of optimal combinations of tires 120 and wheel rims 118 in wheel assemblies 116 to minimize vibration due to radial forces, and the facilitation of the identification of optimal combinations of wheel assemblies 116 to minimize vehicle pull due to lateral forces.

Optionally, in balancing systems 100, configured with a load roller 113, the data stored in an RFID transponder of tag 22 associated with a wheel assembly 116 is read by the RFID interrogator 20 to determine a size or load rating for the tire 120. The balancing system 100 is configured to set a force applied to the tire 120 by the load roller 113 to a constant percentage of the tire load rating. If the tire load rating is not known, the balancing system 100 can calculate a load rating value based upon the tire size information retrieved from the RFID transponder or tag 22.

To facilitate mounting of the wheel assembly 116 on the spindle 102, the balancer system 100 is optionally configured to retrieve data representative of a wheel pilot hole diameter or wheel bolt pattern from the RFID transponder or tag 22 associated with the wheel assembly 116. The balancer system 100 is configured to utilize this information to identify suitable sizes for accessory components, such as cones or flanges, to secure the wheel assembly 116 to the spindle 102.

Typically, rim runout remains constant over the lifetime of a tire 120. Accordingly, values for rim runout, such as the AIAG B-11 DI "5N79-Wheel Outboard Beadseat Radial First Harmonic: inches", AIAG B-11 DI "5N81-lnboard Beadseat Radial First Harmonic: inches", and the AIAG B-11 DI "5N78-Wheel Average Radial First Harmonic Low Point Location" optionally is retrieved from the RFID transponder or tag 22 by the RFID interrogator 20 to provide the balancer system 100 with stored rim radial runout values, eliminating a need for the balancing system 100 to directly measure rim radial runout. The balancer system 100 is optionally configured to further utilize stored rim radial runout values, together with measured radial force values, to determine if the tire 120 is optimally positioned on the wheel rim 118.

Figure 7:
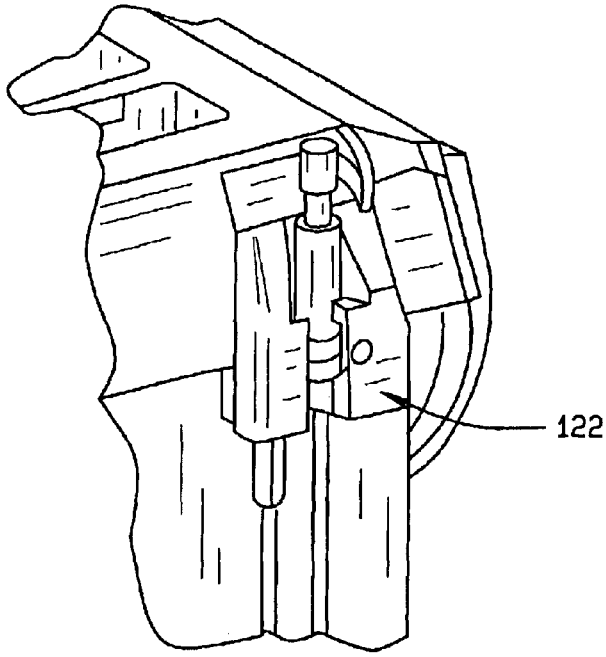
FIG. 7 is an enlarged perspective view of an optional tire inflation system on the wheel balancer system of FIG. 5.
Figure 8:
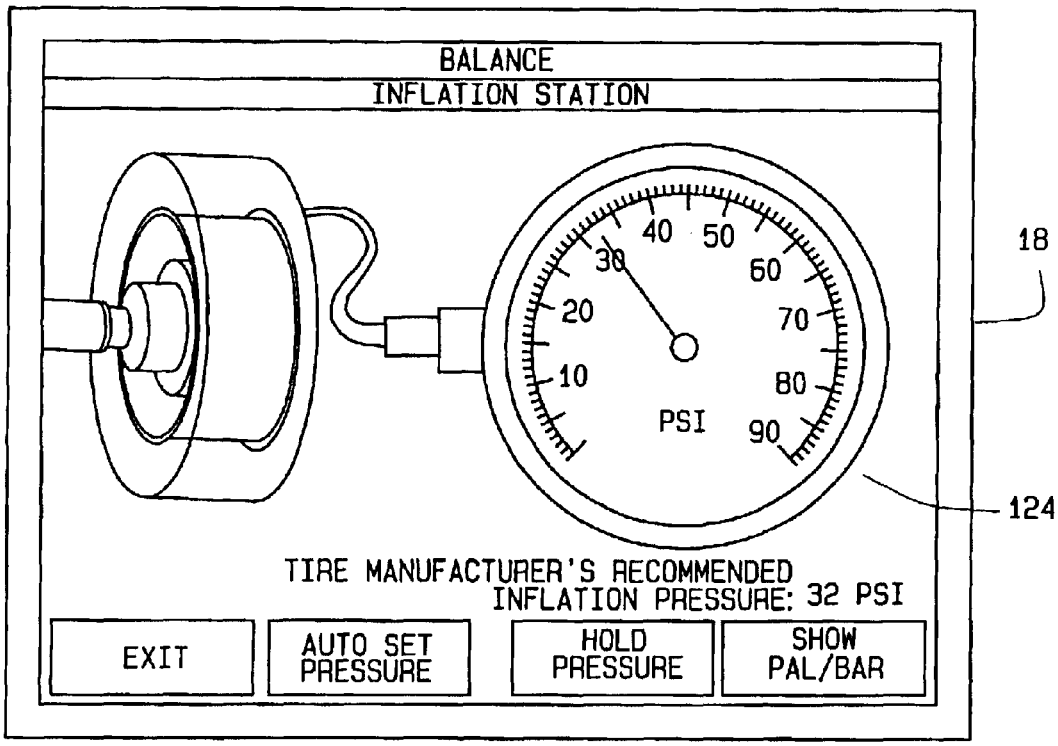
FIG. 8 is an exemplary display providing an operator with tire inflation information.

In vehicle wheel balancer systems 100 configured with optional tire inflation systems 122, shown in FIG. 7, the RFID interrogator 20 can retrieve data from the RFID transponder or tag 22, associated with the tire 120 representative of recommended tire inflation pressure, such as the AIAG B-11 DI "5N36-Tire Pressure (PSIA) Design Load-Front: psi" and AIAG B-11 DI "5N39-Tire Pressure (PSIA) Design Load-Rear: psi" data values. The balancer system 100 is configured to utilize the retrieved data to provide an operator with a indication 124 of the target pressure for tire inflation on display 18, as shown in FIG. 8, or to control the optional tire inflation system 122 during a tire inflation procedure.

Optionally, the balancer system 100 is configured to retrieve, through the RFID interrogator 20, data from the RFID transponder or tag 22 identifying the type of balance weight flange 126 on the wheel rim 118 of the wheel assembly 116. Under the AIAG B-11 Standard, this information is identified as DI "5N54-MANDATORY: Wheel Identification Code (WIC); Label". Using this retrieved information, the balancer system 100 is configured to identify to an operator the correct type of clip-on balance correction weight 128 for use with the selected wheel assembly 116. Exemplary types of clip-on balance correction weights 128, and the associated balance weight flanges 126 for which they are designed, are shown in FIG. 9.

Optionally, the balancer system 100 is configured to retrieve, through the RFID interrogator 20, data from the RFID transponder or tag 22 identifying the rim material type of the wheel rim 118. The rim material type is optionally used by the balancer system 100 as a criteria in automatically determining whether to recommend the use of clip-on balance correction weights or adhesive balance correction weights.

Optionally, the balancer system 100 is configured to retrieve, through the RFID interrogator 20, data from the RFID transponder or tag 22, identifying the profile of the wheel rim 118 from a set of predetermined wheel rim profiles, such as those set forth in the Tire and Rim Association "2002 Year Book", an industry standard publication of wheel rim profiles. The wheel rim profile type is optionally used by the balancer system 100 to select one or more adhesive weight locations, eliminating the need to manually enter adhesive weight plane dimensions, or perform wheel rim profile measurements.

Optionally, the balancer system 100 is configured to retrieve, through the RFID interrogator 20, data from the RFID transponder or tag 22 identifying a size of the tire 120 and a size of the wheel rim 118. The balancer system 100 optionally utilizes tire size and rim size information to verify that the tire 120 can be safely mounted on the wheel rim 118 using predetermined match ranges. For example, the Tire and Rim Association, an industry group, defines the range of tire sizes that can be mounted on a given rim size, i.e. P205/65-16 tires can safely be mounted on rims that are 5.5 inches to 7.5 inches wide, and are 16 inches in diameter.

Optionally, the balancer system 100 is configured to retrieve, through the RFID interrogator 20, data from the RFID transponder or tag 22 identifying tire conicity values previously measured and stored in the RFID transponder or tag 22 for each wheel assembly 116 in a set. Under the AIAG B-11 standard, such data is stored in the RFID transponder or tag 22 under DI "5N33-Tire Conicity Value: pounds". After obtaining conicity data for two or more wheel assemblies 116 in a set, the balance system 100 could utilize the information to identify to a technician an optimal placement of the wheel assemblies 116 about a vehicle in such a way as to eliminate vehicle pull caused by tire conicity. Optimal placement is identified by the balancer system 100 as a placement in which the conicity effects of tires on opposite sides of a vehicle axle counteract each other to result in a minimum net conicity effect.

Optionally, the balancer system 100 is configured to retrieve, through the RFID interrogator 20, data from the RFID transponders or tags 22 on several wheel assemblies 116, and to utilize the retrieved data to perform a self-calibration procedure or accuracy check for actual measurements made by the balancer system 100. For example, the balancer system 100 optionally is configured to compare measured tire conicity values with conicity data retrieved from the RFID transponders or tags 22 on each tire. A comparison of each measured conicity value with an associated retrieved conicity value yields an average measurement lateral force offset amount, which the computer 12 of the balancer system 100 may subsequently utilize to "correct" future conicity measurements. Those of ordinary skill in the art will recognize that a corresponding radial force offset amount optionally is calculated by the balancer system 100 for radial force measurements, by comparing measured radial forces with radial force measurements retrieved from the RFID transponder or tag 22 of each tire.

Optionally, the balancer system 100 is configured to retrieve, through the RFID interrogator 20, data from the RFID transponders or tags 22 representative of the manufacturer tire imbalance measurements. Operating under the assumption that the wheel assembly 116 is new, and has not been changed from conditions under which the manufacturer tire imbalance measurements were obtained, the balancer system 100 may provide to an operator with suggested placements for one or more imbalance correction weights about the wheel rim assembly 116 to correct the manufacturer tire imbalance measurements, without requiring additional imbalance measurements, resulting in a significant time savings for an operator when balancing "new" wheel assemblies 116 for a first time.

Optionally, the balancer system 100 is configured to retrieve, through the RFID interrogator 20, data from the RFID transponders or tags 22 representative of the bolt pattern of the wheel rim 118. The wheel rim bolt pattern is utilized by the balancer system 100 to identify a predetermined bolt-tightening or torque pattern for display to an operator. The bolt-tightening or torque pattern is important for an operator to follow when installing a wheel assembly 116 on a vehicle because if the wheel assembly 116 is not installed on the vehicle properly, a brake rotor associated with the installed wheel assembly may eventually warp due to inconsistent stresses around the brake rotor caused by improper torque on the mounting bolts.

In addition to reading and utilizing data stored in an RFID transponder or tag 22 associated with a wheel assembly 116, a balancer system 100 is optionally configured to modify the stored data on the RFID transponder or tag 22, or to add new data to the RFID transponder or tag 22. To add or modify data stored in an RFID transponder or tag 22, a software application operating in the computer 12 of the balancer system 100 directs the RFID interrogator 20 to convey the new or modified data to the RFID transponder or tag 22, over the wireless communications link, together with any required instructions for storage therein.

The following examples are illustrative of some of the general types of information which the balancing system 100 may store in an RFID transponder or tag 22 associated with a wheel assembly 116. These examples are not intended as limiting, and those of ordinary skill in the art will recognize that numerous types of data useful in wheel assembly balancing procedures optionally are stored in an RFID transponder or tag 22 associated with a wheel assembly 116, wheel rim 118, or tire 120 by a balancer system 100 of the present invention.

Optionally, measured balance parameters are communicated to the RFID transponder or tag 22 for storage from the balancer system 100 through the associated RFID interrogator 20. These may include conicity of the pneumatic tire 120, radial force variation of the pneumatic tire 120, radial force variation high point location, rim lateral and radial runout, and rim runout low point location, as well as measured static and dynamic imbalance values.

Optionally, general data related to balancing procedures carried out by the balancer system 100 are stored in the RFID transponder or tag 22 by the balancer system 100. These may include tire and rim match codes generated by the balancer system 100 for use in selecting optimal combinations of tires and rims, date and mileage information on when the tire 120 or wheel assembly 116 was purchased, balanced, or when a leak was fixed, tire wear information (tread depth versus miles on the tire), and numerous entries of date, and mileage when a tire 120 was retreaded.

Tire retread information is particularly important in the service of heavy-duty trucks, where tire life can be extended by retreading the tire 120 up to 7 times or more.

Optionally, data related to corrective actions taken following balancing procedures carried out by the balancer system 100 are stored in an RFID transponder or tag 22 associated with a wheel assembly 116, by the balancer system 100. This data may include wheel location identification, corresponding to a recommended location on a vehicle for a balanced wheel assembly 116. Wheel location identification information optionally is subsequently utilized by a balancer system 100 or another automotive service system 10 to manage the rotation of wheel assemblies 116, while keeping vehicle pull and vibration to a minimum. Optionally, the data stored by the balancer system 100 on the RFID transponder or tag 22 may include tire tread depth, tire mileage, and/or inflation pressure, permitting subsequent tracking of tire wear, the date of the most recent balance measurements for the wheel assembly 116, and the size, number, and location of installed imbalance correction weights.

The information stored on an RFID transponder or tag 22 by a balancer system 100 optionally is subsequently used by the balancer system 100, another automotive service system 10, or automotive service shop to collect statistical data from tires 120 and wheel assemblies 116 for product analysis.

In an alternate embodiment shown in FIGS. 10 and 11, the improved automotive vehicle service system 10 of the present invention is configured as a vehicle wheel alignment system 200 with one or more conventional alignment angle sensors 202 for obtaining measurements of the various alignment angles and/or characteristics of the vehicle 24 undergoing service. The alignment angle sensing devices 202, depending upon the application and requirements, can be electronic, electromechanical, or optical alignment targets and cameras. The alignment angle sensing devices 202 are operatively coupled to the computer 12 to provide measurement data associated with one or more vehicle wheel alignment angles of the vehicle 24 undergoing service for subsequent processing by a wheel alignment software application.

The operation of the various components and software applications of a wheel alignment system, and the wheel alignment system 200 in general, is well known to those of ordinary skill in the wheel alignment field. It should be understood that the above description is included for completeness only, and that various other wheel alignment systems could be used with the present invention. An exemplary wheel alignment system 200 is the 611 Series of vehicle wheel aligners manufactured and sold by Hunter Engineering Company of Bridgeton, Mo. The 611 Series wheel alignment systems utilize either wheel mounted alignment sensors such as the DSP-300 series sensors, or optical sensors such as the DSP-400 series sensors to measure wheel alignment angles, both of which are manufactured and sold by Hunter Engineering Company.

Operatively coupled to the computer 12 of the vehicle wheel alignment system 200 is at least one RFID interrogator 20, having a reader/antenna 21, and configured to exchange data over a wireless communications link with one or more RFID transponders or tags 22, each having an antenna coil 23, and associated with either a vehicle 24 undergoing a wheel alignment procedure, or with one or more components 26 associated with the vehicle 24. The components 26 optionally are alignment components, suspension components, or steering components already installed on the vehicle 24, or may comprise components which have either been removed from, or not yet installed on, the vehicle 24. Each RFID transponder or tag 22 advantageously requires no self-contained battery for operation. Instead, the RFID transponder or tag 22 obtains operating power from the radio frequency (RF) or electromagnetically coupled RFID interrogator 20 when in proximity thereto.

A single RFID interrogator 20 is operatively coupled to the computer 12 of the vehicle wheel alignment system 200. Preferably, the single RFID interrogator 20 is disposed in operative proximity to a vehicle 24 undergoing a wheel alignment, such that all RFID transponders or tags 22 associated with the vehicle 24 or components 26 are in the communication range of the RFID interrogator 20.

Figure 12:
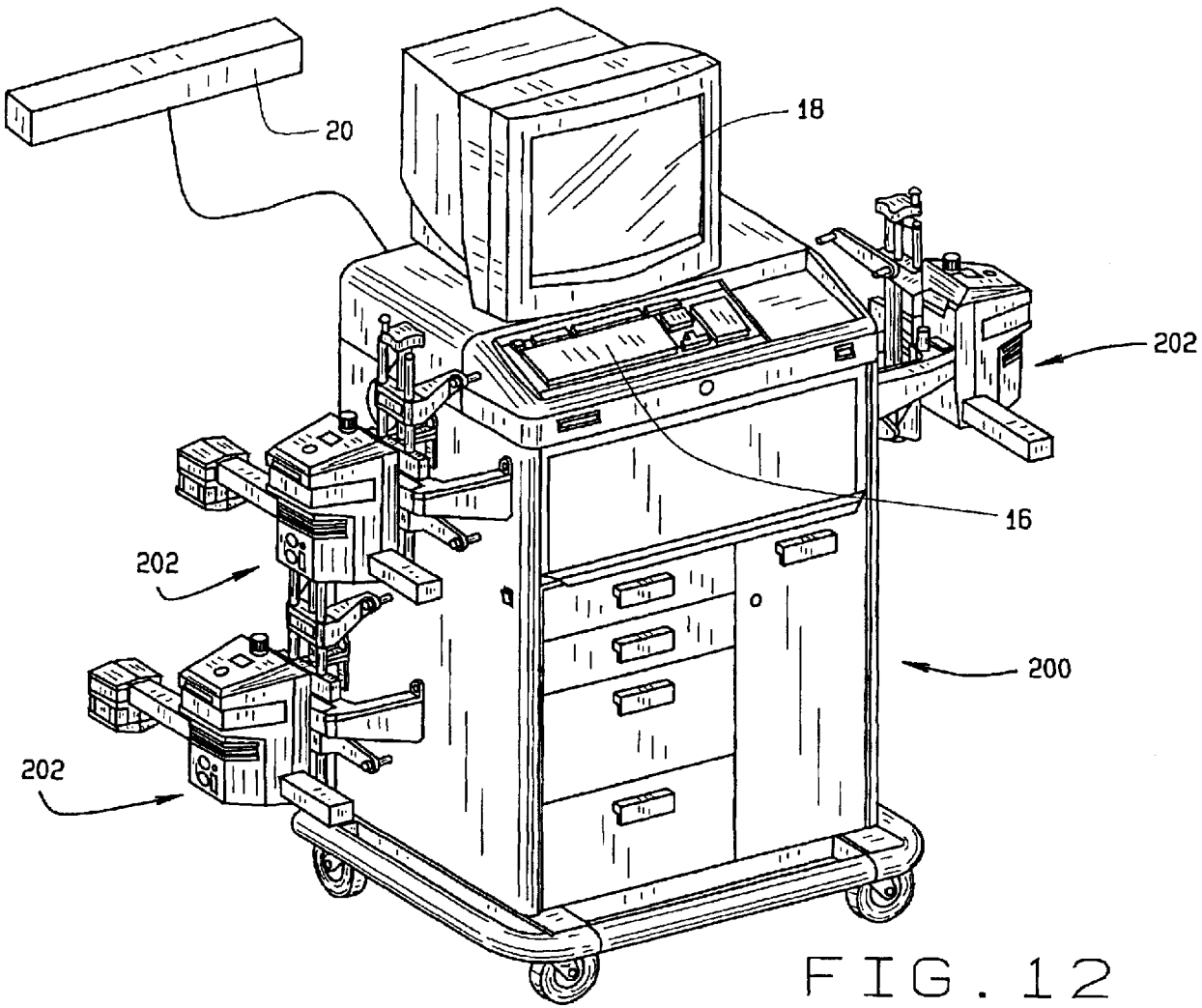
FIG. 12 is a perspective view of a vehicle wheel alignment system of FIG. 10.

In an alternate embodiment, multiple RFID interrogators 20 are operatively coupled to the computer 12 of the vehicle wheel alignment system 200. As shown in FIG. 12, each of the multiple RFID interrogators 20 is disposed in an alignment angle sensing devices 202, and as such, is disposed in operative proximity to a vehicle 24 undergoing a wheel alignment procedure when the associated alignment angle sensing device is utilized. Disposing an RFID interrogator 20 on each alignment angle sensing device 202 results in each RFID interrogator 20 being brought into close proximity to vehicle suspension and steering components 26 associated with an individual wheel assembly 116 during use of the alignment angle sensing device 202, facilitating an electromagnetic coupling with RFID transponders or tags 22 which may be partially shielded by the vehicle body, wheel assembly, or brake components. The RFID interrogator is generally brought closer to the vehicle tires advantageously lowering the power requirement for the magnetic field established by the RFID interrogator.

Optionally, an RFID interrogator 20 is disposed in a handheld or portable unit suitable for an operator to move around a vehicle 24, or operatively coupled to the computer 12 via a conventional wireless communications link, such as an infrared or radio-frequency data link.

The computer 12 in the vehicle wheel alignment system 200 is configured with a software application to either communicate with or to control one or more RFID interrogators 20, and to extract stored data from the RFID transponders or tags 22 prior to, or during, an alignment procedure over the electromagnetic coupling or wireless communications link between the RFID interrogator antenna coils 21 and each RFID transponder or tag antenna coil 23. The wheel alignment software application operating on the computer 12 of the vehicle wheel alignment system 200 is configured to utilize the extracted data to facilitate the completion of one or more vehicle alignment procedures.

The following examples are illustrative of some of the general types of information which the vehicle wheel alignment system 200 may retrieve and utilize from an RFID transponder or tag 22 associated with a vehicle 24 or component 26. These examples are not intended as limiting, and those of ordinary skill in the art will recognize that numerous types of data useful in wheel alignment procedures optionally are stored and retrieved from an RFID transponder or tag 22 associated with the vehicle 24 or components 26. Utilization of the various types of stored data by the vehicle wheel alignment system 200, as set forth in detail below, is regulated by the one or more software applications with which the computer 12 of the vehicle wheel alignment system 200 is configured, and alteration of the software applications to utilize different types of data retrieved from an RFID transponder or tag 22 is considered routine to one of ordinary skill in the art.

Optionally, the vehicle wheel alignment system 200 is configured to utilize predetermined alignment specifications stored in an RFID transponder or tag 22 associated with a vehicle 24 or component 26 during alignment of the vehicle wheel assemblies 116. The stored alignment specifications are retrieved from the vehicle RFID transponder or tag 22 via a RFID interrogator 20 associated with the vehicle wheel alignment system 200. The vehicle wheel alignment system 200 utilizes the retrieved predetermined alignment specifications in place of, or in conjunction with, predetermined alignment specifications stored in a database, to guide an operator in adjusting the actual vehicle wheel alignment angles.

Optionally, the vehicle wheel alignment system 200 is configured to retrieve, through the RFID interrogator 20, data from the RFID transponder or tag 22 identifying tire conicity values previously measured and stored in the RFID transponder or tag 22 for each wheel assembly 116 mounted on a vehicle 24 undergoing an alignment procedure. Under the AIAG B-11 standard, such data is stored in the RFID transponder or tag 22 under DI "5N33-Tire Conicity Value: pounds". After obtaining conicity data for two or more wheel assemblies 116 on the vehicle 24, the vehicle wheel alignment system 200 is configured to utilize the information to identify to a technician an optimal placement of the wheel assemblies 116 about the vehicle 24 in such a way as to eliminate vehicle pull caused by tire conicity. Optimal placement is identified by the vehicle wheel alignment system 200 as a placement in which the conicity effects of tires on opposite sides of a vehicle axle counteract each other to result in a minimum net conicity effect.

A key concept in wheel alignment is to specify a "reference diameter" to define where a linear toe alignment specification is measured on a given vehicle. It is common for Japanese vehicle manufacturers to specify a linear toe value measured at the tire tread, which makes the reference diameter the overall diameter of the tire 120. For example, if a vehicle 24 includes wheel assemblies 116 consisting of a 16 inch wheel rim 118 and a tire 120 having 4 inch sidewall, the reference diameter is 24 inches (16+4+4). This reference diameter is normally provided to the user by the vehicle wheel alignment system 200 via an alignment specifications database 204 operatively coupled to the computer 12. The reference diameter allows the linear measurement to be converted to an angular measurement, as measured by an alignment sensor 202. Typically, French and Italian vehicle manufacturers specify a reference diameter measured across the wheel rim 118 (i.e. 15", 16", 17", etc.). In the United States of America, light duty vehicle manufacturers specify toe at an agreed upon Society of Automotive Engineers (SAE) standard reference diameter of 28.65 inches. Heavy duty vehicle manufacturers typically specify toe measured at the tire tread, similar to the Japanese manufacturers. The heavy duty vehicle reference diameter, however, is generally not supplied in an alignment specifications database 204. Conventionally, during use, the vehicle wheel alignment system 200 prompts the operator to measure the diameter of the steering axle tires 120, which the operator is then required to input into the alignment system 200. In an optional embodiment, the vehicle wheel alignment system 200 of the present invention utilizes the RFID interrogator 20 to access data stored in an RFID transponder or tag 22 associated with a vehicle wheel 120 representative of the actual wheel size. The accessed data is communicated to the wheel alignment software application on computer 12, and subsequently utilized to determine a reference diameter, eliminating the need for an operator to manually input wheel size information during a vehicle wheel alignment procedure.

Optionally, the wheel alignment system 200 is configured to retrieve, through the RFID interrogator 20, data from the RFID transponders or tags 22 representative of the bolt pattern of the wheel rim 118. The wheel rim bolt pattern is utilized by the wheel alignment system 200 to identify a predetermined bolt-tightening or torque pattern for display to an operator. The bolt-tightening or torque pattern is important for an operator to follow when re-installing a wheel assembly 116 on a vehicle 24 following removal for adjustment of a suspension component. If the wheel assembly 116 is not installed on the vehicle 24 properly, a brake rotor associated with the installed wheel assembly 116 may eventually warp due to inconsistent stresses around the brake rotor caused by improper torque on the mounting bolts.

Figure 13:
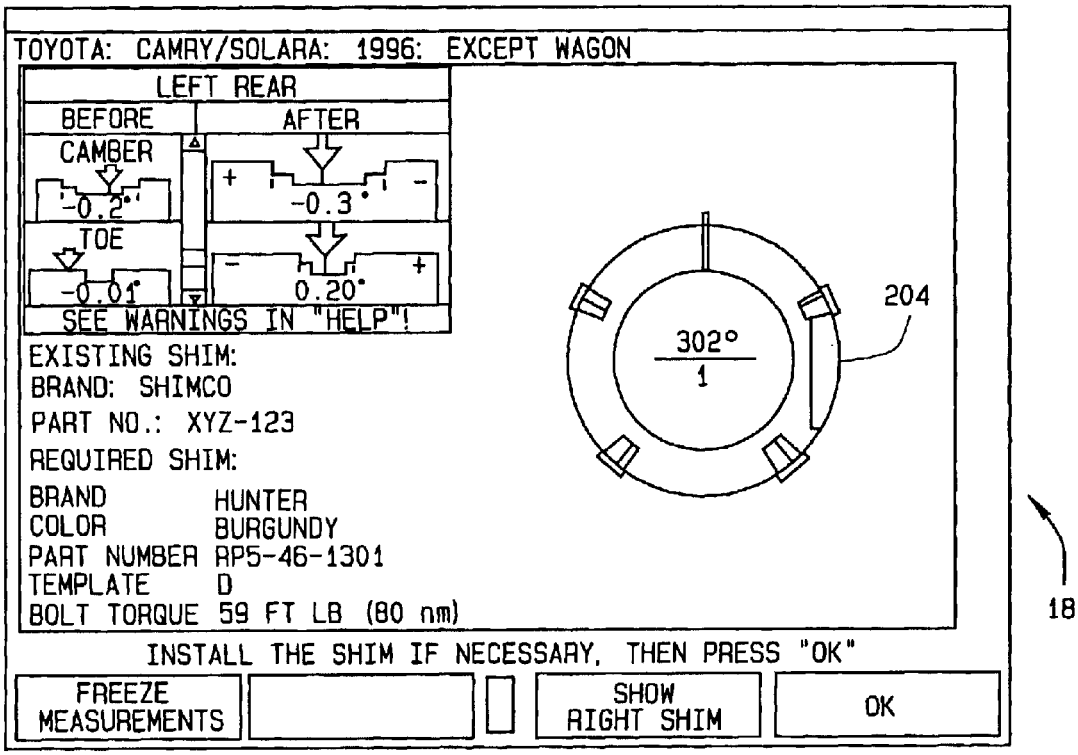
FIG. 13 is an exemplary display of alignment shim information.
Figure 14:
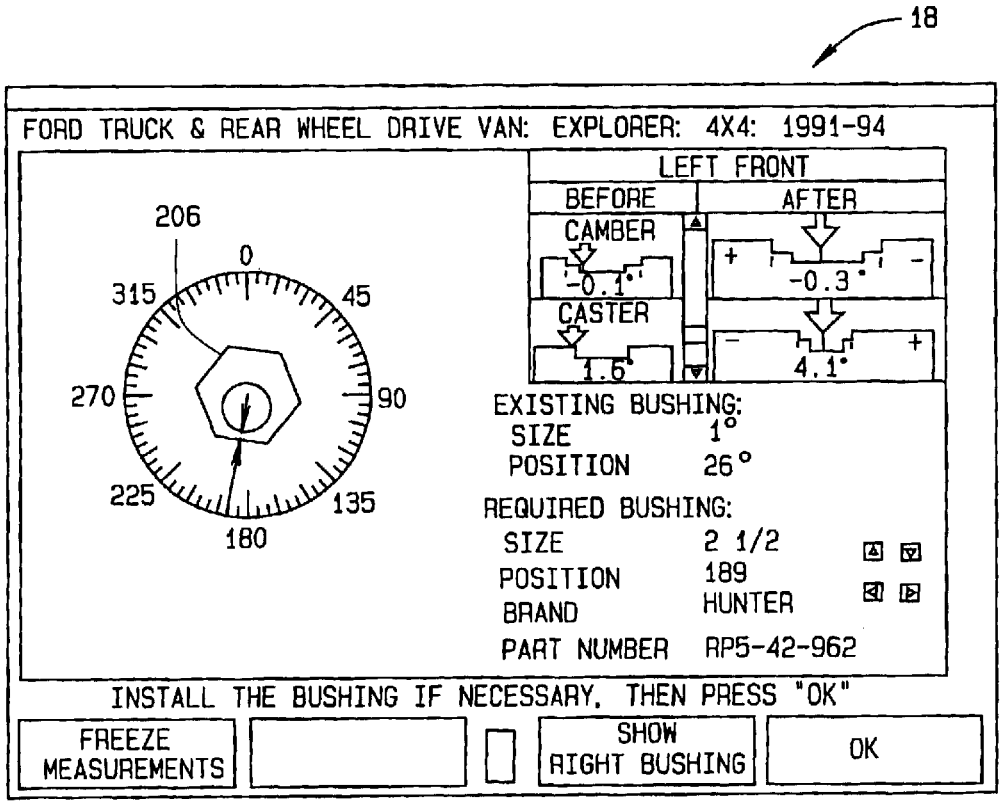
FIG. 14 is an exemplary display of alignment bushing information.

Optionally, the wheel alignment system 200 is configured to retrieve, through the RFID interrogator 20, data from the RFID transponders or tags 22 associated with automotive service parts or components 26 utilized in vehicle wheel alignment procedures. These automotive service parts or components 26 may include, but are not limited to, alignment shims 204,,suspension bushings 206, suspension springs, or shock absorbers. Data retrieved by the vehicle wheel alignment system 200 from an automotive service part or component 26 may include, but is not limited to, manufacturer, part number, part specifications, or installation information such an orientation at which the component was previously installed. The vehicle wheel alignment system 200 is configured to utilize the retrieved information during a vehicle wheel alignment procedure. For example, an alignment system 200 could extract data from an RFID transponder or tag 22 associated with an installed alignment shim to identify the type of shim 204 installed, and determine any effects on the vehicle alignment from the installed alignment shim 204. As shown in FIGS. 13 and 14, the alignment system 200 identifies to an operator the type of shim 204 or bushing 206 installed on the vehicle 24, and recommends to an operator, a suitable replacement component such as a shim 204 or bushing 206, and any required installation parameters, to complete a vehicle wheel alignment operation.

Optionally, the wheel alignment system 200 is configured to retrieve, through the RFID interrogator 20, data from the RFID transponders or tags 22 representative of the vehicle steering components and system of the vehicle undergoing an alignment service. Predetermining whether the vehicle has a power steering system or an electronic steer-by-wire steering system is required to provide an operator with instructions regarding starting the vehicle's engine before attempting to turn the vehicle's steering wheel, as is required by some alignment procedures.

In addition to reading and utilizing data stored in an RFID transponder or tag 22 associated with a vehicle 24 or component 26, a wheel alignment system 200 is optionally configured to modify the stored data on the RFID transponder or tag 22, or to add new data to the RFID transponder or tag 22. To add or modify data stored in an RFID transponder or tag 22, a software application operating in the computer 12 of the wheel alignment system 200 directs the RFID interrogator 20 to convey the new or modified data to the RFID transponder or tag 22, over the wireless communications link, together with any required instructions for storage therein.

The following examples are illustrative of some of the general types of information which the wheel alignment system 200 may store in an RFID transponder or tag 22 associated with a vehicle 24 or component 26. These examples are not intended as limiting, and those of ordinary skill in the art will recognize that numerous types of data useful in alignment procedures optionally are stored in an RFID transponder or tag 22 associated with a vehicle 24 or component 26 by a wheel alignment system 200 of the present invention.

Optionally, measured alignment values are communicated to a vehicle RFID transponder or tag 22 for storage from the wheel alignment system 200 through the associated RFID interrogator 20. Measured alignment values may include, but are not limited to, the final toe, camber, and caster values to which the vehicle 24 was aligned at the completion of a vehicle wheel alignment procedure.

Optionally, installation data is communicated to a component RFID transponder or tag 22 for storage from the wheel alignment system 200 through the associated RFID interrogator 20. Installation data may include, but is not limited to, an installation angle/orientation, size, and type of a shim or bushing, and an installation date.

The information stored on an RFID transponder or tag 22 by a wheel alignment system 200 optionally is subsequently used by the wheel alignment system 200, another automotive service system 10, or automotive service shop to collect statistical data from vehicles 24 or components 26 for product analysis.

Figure 15:
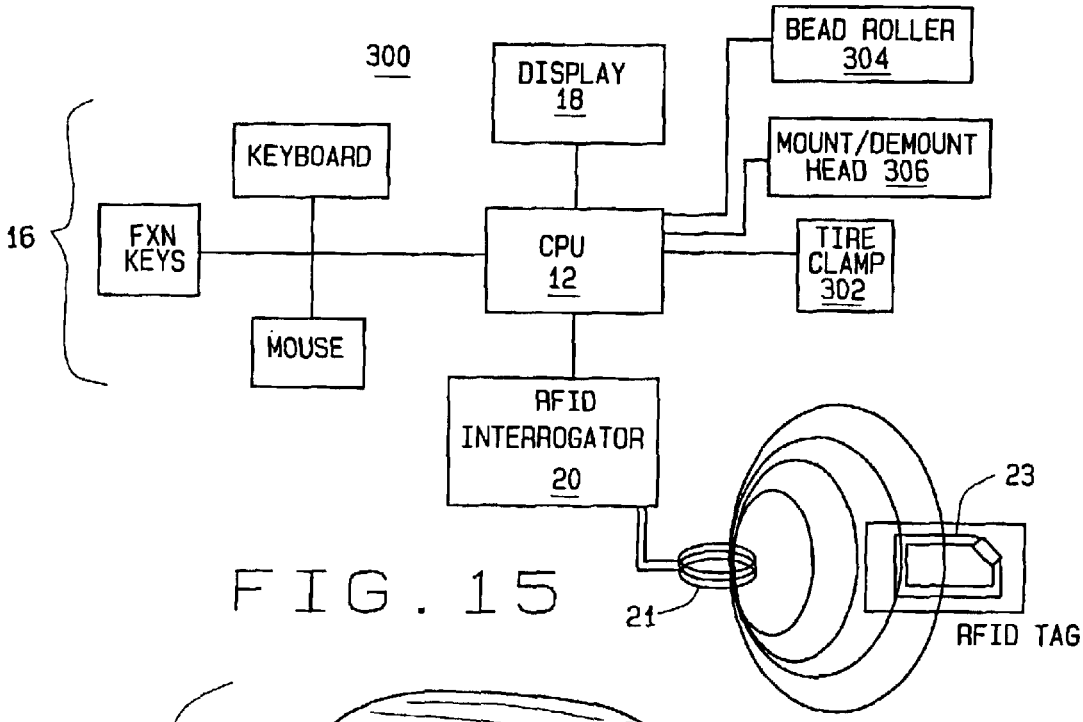
FIG. 15 is a block diagram view of the components of a automotive tire changer system of the present invention.

In an alternate embodiment shown in FIG. 15, the improved automotive vehicle service system 10 of the present invention is configured as an automotive tire changer system 300 with a rotating tire clamping system 302, bead roller assembly 304, and a mount/demount head 306 disposed on a movable arm 308. To mount or dismount a tire 120 from a wheel rim 118 in a vehicle wheel assembly 116, the wheel assembly 116 is first secured in the tire clamping system 302. Next, the tire wheel assembly 116 is rotated through one or more complete revolutions while the tire 120 is either deflated and dismounted from the wheel rim 118 by the bead roller assembly 304, or the tire 120 is seated on the wheel rim 118 by the mount/demount head 306 and subsequently inflated to a desired pressure.

The operation of the various components of an automotive tire changer system 300 described above, and the automotive tire changer system 300 in general, is well known to those of ordinary skill in the automotive tire changer field. It should be understood that the above description is included for completeness only, and that various other tire changer systems could be used. An exemplary automotive tire changer system 300 is the TC3500 series of automotive tire changer systems manufactured by Butler Engineering & Marketing S.r.I. of Rio Saliceto (RE), Italy and sold by Hunter Engineering Company of Bridgeton, Mo.

Operatively coupled to the computer 12 of the automotive tire changer system 300 is at least one RFID interrogator 20, having a reader/antenna 21, and configured to exchange data over a wireless communications link with one or more RFID transponders or tags 22, each having an antenna coil 23, and associated with a wheel assembly 116 undergoing a balancing procedure, consisting of a wheel rim 118 and a pneumatic tire 120.

Optionally, the RFID interrogator 20 is disposed in a handheld or portable unit suitable for an operator to move around their facility reading RFID tags from tires and rims not mounted on the tire changer. The handheld RFID interrogator may be operatively coupled to the computer 12 via a conventional wireless communications link, such as an infrared or radio-frequency data link.

The computer 12 in the automotive tire changer system 300 is configured with a software application to communicate with or to control the RFID interrogator 20, and to stored data from the RFID transponders or tags 22 prior to, or during, a tire changing procedure over the electromagnetic coupling or wireless communications link between the RFID interrogator antenna 21 and each RFID transponder or tag antenna coil 23. The tire changer software application operating on the computer 12 of the automotive tire changer system 300 is configured to utilize the extracted data to facilitate the completion of one or more tire changing procedures.

The following examples are illustrative of some of the general types of information which the automotive tire changer system 300 may retrieve and utilize from an RFID transponder or tag 22 associated with a wheel assembly 116. These examples are not intended as limiting, and those of ordinary skill in the art will recognize that numerous types of data useful in tire changing procedures optionally is stored and retrieved from an RFID transponder or tag 22 associated with a wheel assembly 116, wheel rim 118, or tire 120. Utilization of the various types of stored data by the automotive tire changer system 300, as set forth in detail below, is regulated by the one or more software applications with which the computer 12 of the automotive tire changer system 300 is configured, and alteration of the software applications to utilize different types of data retrieved from an RFID transponder or tag 22 is considered routine to one of ordinary skill in the art.

Data stored in an RFID transponder or tag 22 associated with a vehicle wheel assembly 116 and retrieved by a RFID transponder 20 in the automotive tire changer system 300 optionally is representative of AIAG B-11 Standard data fields and data identifiers (DI), such as, but not limited to manufacturer information, tire pressure, and tire parameters.

Optionally, the automotive tire changer system 300 is configured to retrieve, through the RFID interrogator 20, data from the RFID transponder or tag 22 identifying the type of tire 120 on which the automotive tire changer system 300 is operating. For example, the AIAG B-11 DI "5NB3-Tire Type" could be read from an RFID transponder or tag 22 associated with the tire 120. The tire type data is utilized by the automotive tire changer system 300 as criteria in unseating the tire bead from the bead seat. In an extreme case, a run-flat tire is handled by the automotive tire changer system 300 entirely different from a PAX tire.

Figure 16:
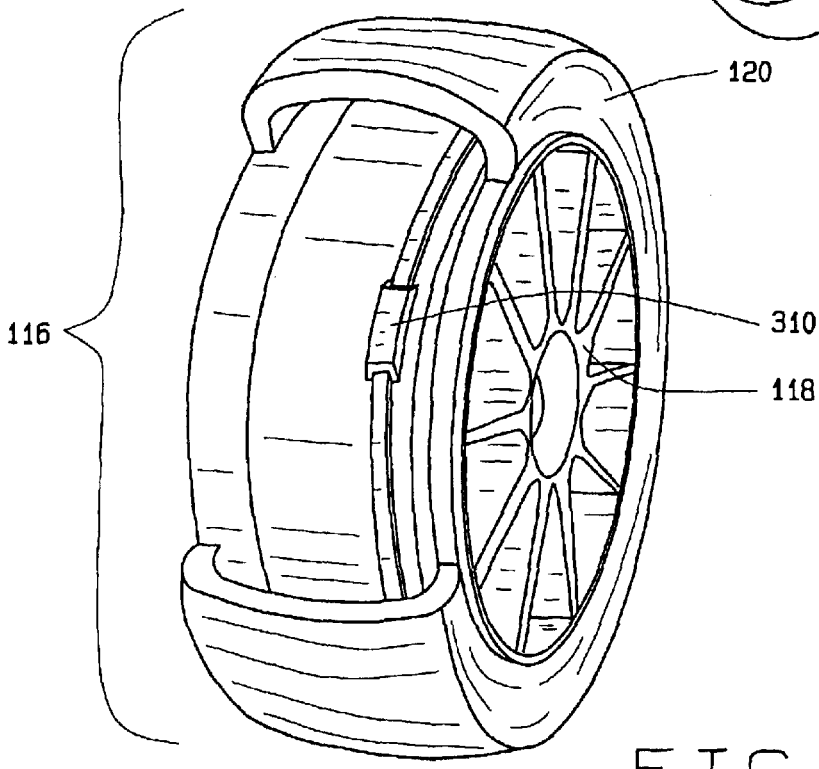
FIG. 16 is a perspective partial sectional view of a wheel assembly and installed tire pressure sensor.

Optionally, the automotive tire changer system 300 is configured to retrieve, through the RFID interrogator 20, data from the RFID transponder or tag 22 indicating the presence and type of a tire pressure sensor 310 installed in a wheel assembly 116, such as shown in FIG. 16 For example, the AIAG B-11 DI "5NA6-Tire Pressure Monitor Part Number" or AIAG B-11 DI "5NA7-Tire Pressure Monitor Serial Number" could be read by the automotive tire changer system 300. This information is critical to an automotive tire changer system 300 because when the bead 312 of a tire 120 is unseated from the bead seat 314 on the wheel rim 118, there is a chance of deflecting the sidewall 316 of the tire 120 too much, and damaging an installed tire pressure sensor 310. If the presence of a tire pressure sensor or monitor 310 is known, the type of monitor has been matched by the automotive tire changer system 300 to a database of tire pressure sensors 310, the automotive tire changer system 300 may obtain related tire pressure monitor size information. This information is displayed to an operator to reduce the risk of damaging the sensor 310 during a tire changing operation carried out on the automotive tire changer system 300.

Optionally, the automotive tire changer system 300 is configured to retrieve, through the RFID interrogator 20, data from the RFID transponder or tag 22 identifying rim runout and radial force measurements of a wheel assembly 116. For example, the AIAG B-11 DI "5N79-Wheel Outboard Beadseat Radial First Harmonic: inches", AIAG B-11 DI "5N81-lnboard Beadseat Radial First Harmonic: inches", or the AIAG B-11 DI "5N78-Wheel Average Radial First Harmonic Low Point Location" could be read by the automotive tire changer system 300 to determine the rim radial runout. Since rim runout typically does not change, this information is used by the automotive tire changer 300 in conjunction with measured radial forces of the wheel assembly obtained on a balance system 100, to determine whether or not force matching between the wheel rim 118 and tire 120 of the wheel assembly 116 will be successful, and if so, how to rotationally position the tire 120 relative to the wheel rim 118 during mounting.

In automotive tire changer systems 300 configured with optional tire inflation systems 310, the RFID interrogator 20 is utilized to retrieve data from the RFID transponder or tag 22 associated with the tire 120 which is representative of a recommended tire inflation pressure, such as the AIAG B-11 DI "5N36-Tire Pressure (PSIA) Design Load-Front: psi" and AIAG B-11 DI "5N39-Tire Pressure (PSIA) Design Load-Rear: psi" data values. The automotive tire changer system 300 is configured to utilize the retrieved data to provide an operator with a display of the target pressure for tire inflation, or to control the optional tire inflation system 310 during a tire inflation procedure.

Optionally, the automotive tire changer system 300 is configured to retrieve, through the RFID interrogator 20, data from the RFID transponder or tag 22 identifying a size of the tire 120 and a size of the wheel rim 118. The tire changer system 300 may utilize tire size and rim size information to verify that the tire 120 can be safely mounted on the wheel rim 118 using predetermined match ranges. For example, the Tire and Rim Association, and industry group, defines the range of tire sizes that can be mounted on a given rim size, i.e. P205165-16 tires can safely be mounted on rims that are 5.5 inches to 7.5 inches wide, and are 16 inches in diameter.

Optionally, the automotive tire changer system 300 is configured to retrieve, through the RFID interrogator 20, data from the RFID transponder or tag 22 identifying tire conicity values previously measured and stored in the RFID transponder or tag 22 for each wheel assembly 116 undergoing a tire changing procedure. Under the AIAG B-11 standard, such data is stored in the RFID transponder or tag 22 under DI "5N33-Tire Conicity Value: pounds". After obtaining conicity data for two or more wheel assemblies 116 associated with a vehicle 24, the automotive tire changer system 300 is configured to utilize the information to identify to a technician an optimal placement of the wheel assemblies 116 about the vehicle 24 in such a way as to reduce vehicle pull caused by tire conicity. Optimal placement is identified by the automotive tire changer system 300 as a placement in which the conicity effects of tires on opposite sides of a vehicle axle counteract each other to result in a minimum net conicity effect.

Optionally, the automotive tire changer system 300 is configured to retrieve, through the RFID interrogator 20, data from the RFID transponder or tag 22 identifying a valve stem location in a wheel assembly. The valve stem location can then be used to position the wheel assembly in an advantageous location for easy attachment of the inflation device used to inflate the tire.

Optionally, the automotive tire changer system 300 is configured to retrieve, through the RFID interrogator 20, data from the RFID transponder or tag 22 identifying rim size. For tire changers, it is important to know the size of the rim so that a high pressure blast of air can be injected between the tire and the rim. This has the effect of expanding the sidewalls of the tire such that the bead seat of the tire makes a seal with the rim close to if not in the bead seat of the rim. Knowing the size of the rim allows accurate positioning of the nozzle responsible for injecting this high pressure blast of air. Under the AIAG B-11 standard, such data is stored in the RFID transponder or tag 22 under DI "5N54-MANDATORY: Wheel Identification Code (WIC); Label".

In addition to reading and utilizing data stored in an RFID transponder or tag 22 associated with a wheel assembly 116, wheel rim 118, or pneumatic tire 120, the automotive tire changer system 300 is optionally configured to modify the stored data on the RFID transponder or tag 22, or to add new data to the RFID transponder or tag 22. To add or modify data stored in an RFID transponder or tag 22, a software application operating in the computer 12 of the automotive tire changer system 300 directs the RFID interrogator 20 to convey the new or modified data to the RFID transponder or tag 22, over the wireless communications link, together with any required instructions for storage therein.

The following examples are illustrative of some of the general types of information which the automotive tire changer system 300 may store in an RFID transponder or tag 22 associated with a wheel assembly 116, wheel rim 118, or pneumatic tire 120. These examples are not intended as limiting, and those of ordinary skill in the art will recognize that numerous types of data useful in wheel assembly balancing procedures optionally are stored in an RFID transponder or tag 22 associated with a wheel assembly 116, wheel rim 118, or pneumatic tire 120 by an automotive tire changer system 300 of the present invention.

Optionally, data representative of an aftermarket installed sensor such as a tire pressure sensor 310, shown in FIG. 16 or a tire temperature sensor is stored in an RFID transponder or tag 22 associated with a wheel assembly 116, wheel rim 118, or pneumatic tire 120 by an automotive tire changer system 300 of the present invention following the mounting of the tire 120 on the wheel rim 118. The stored data may include model, size, and placement information associated with an installed tire pressure sensor 310, enabling a tire changer system 300 or other automotive service system 10 to subsequently retrieve and utilize the information from the RFID transponder or tag 22.

Figure 17:
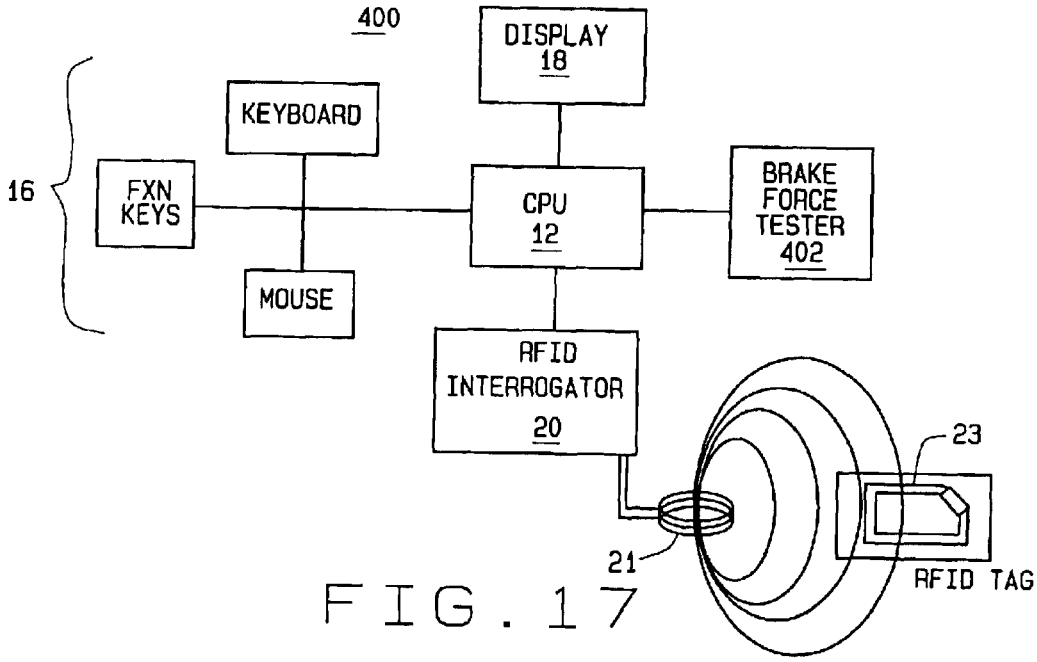
FIG. 17 is a block diagram view of the components of a vehicle brake testing system of the present invention.
Figure 18:
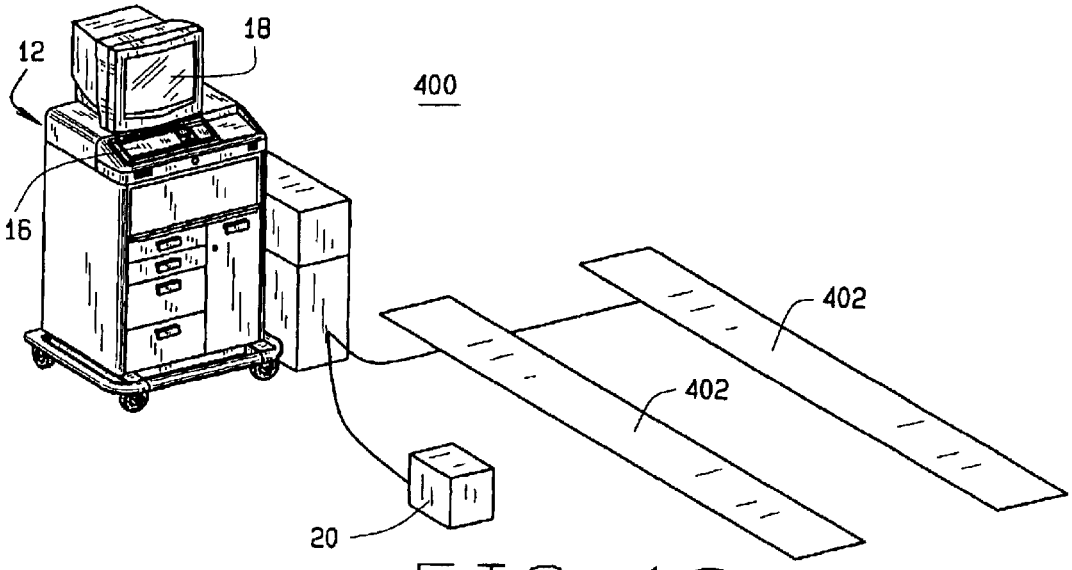
FIG. 18 is a perspective view of a brake testing system of FIG. 17.
Figure 19:
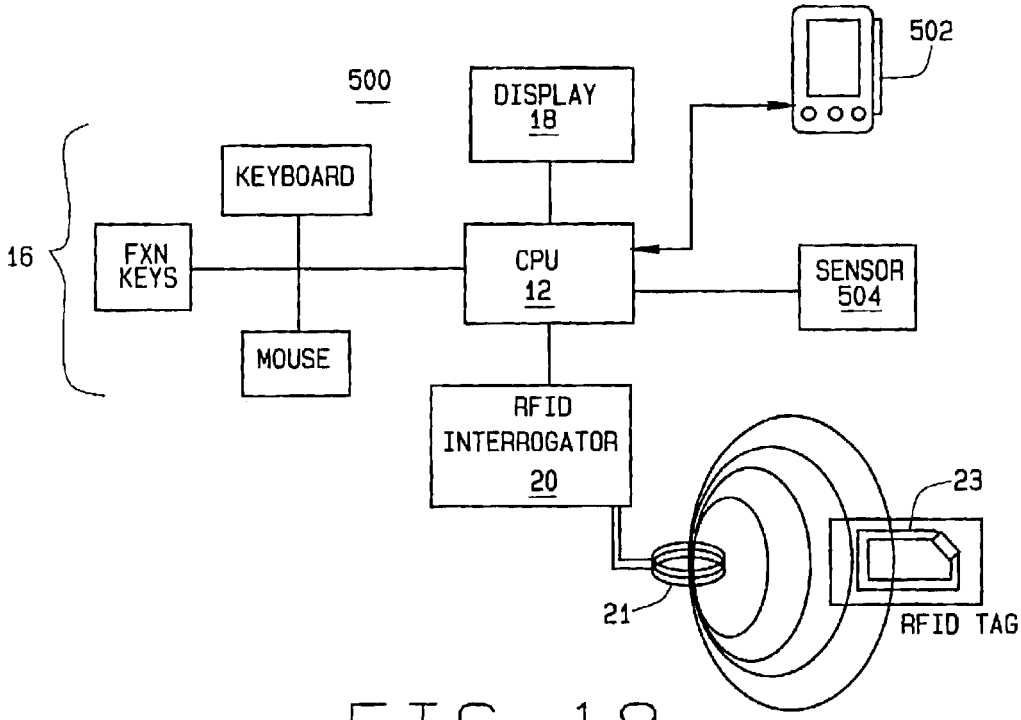
FIG. 19 is a block diagram view of the components of a vehicle inspection system of the present invention.

In an alternate embodiment shown in FIGS. 17 and 18, the improved automotive vehicle service system 10 of the present invention is configured as vehicle brake testing system 400 with one or more brake force testing units 402. To test a vehicle braking system, the vehicle 24 is driven onto the brake force testing unit 402, and the vehicle's brakes applied. The brake testing system 400 is configured to receive signals from the brake force testing unit 402 and to interpret the signals to provide an operator with a representation of the condition of the vehicle's braking system.

The operation of the various components of a vehicle brake testing system 400 described above, and the vehicle brake testing system 400 in general, is well known to those of ordinary skill in the automotive tire changer field. It should be understood that the above description is included for completeness only, and that various other brake testing systems could be used. An exemplary vehicle brake testing system 400 is the B400 Brake Tester system manufactured and sold by Hunter Engineering Company of Bridgeton, Mo.

Operatively coupled to the computer 12 of the vehicle brake testing system 400 is at least one RFID interrogator 20, having a reader/antenna 21, and configured to exchange data over a wireless communications link with one or more RFID transponders or tags 22, each having an antenna coil 23, and associated with a vehicle 24 undergoing a brake testing procedure.

Optionally, the RFID interrogator 20 is be disposed in a handheld or portable unit suitable for an operator to move around the vehicle reading RFID tags. The handheld RFID interrogator may be operatively coupled to the computer 12 via a conventional wireless communications link, such as an infrared or radio-frequency data link.

The computer 12 in the vehicle brake testing system 400 is configured with a software application to communicate with or to control the RFID interrogator 20, and to extract stored data from the RFID transponders or tags 22 prior to, or during, a brake testing procedure over the electromagnetic coupling or wireless communications link between the RFID interrogator antenna 21 and each RFID transponder or tag antenna coil 23. The brake tester software application operating on the computer 12 of the vehicle brake testing system 400 is configured to utilize the extracted data to facilitate the completion of one or more brake testing procedures.

The following examples are illustrative of some of the general types of information which the vehicle brake testing system 400 may retrieve and utilize from an RFID transponder or tag 22 associated with a vehicle 24. These examples are not intended as limiting, and those of ordinary skill in the art will recognize that numerous types of data useful in vehicle brake testing procedures optionally are stored and retrieved from an RFID transponder or tag 22 associated with a vehicle 24. Utilization of the various types of stored data by the vehicle brake testing system 400, as set forth in detail below, is regulated by the one or more software applications with which the computer 12 of the vehicle brake testing system 400 is configured, and alteration of the software applications to utilize different types of data retrieved from an RFID transponder or tag 22 is considered routine to one of ordinary skill in the art.

Optionally, the vehicle brake testing system 400 is configured to retrieve, through the RFID interrogator 20, data from the RFID transponder or tag 22 identifying the wheel base specification of the vehicle. The retrieved data is utilized by the vehicle brake testing system 400 during one or more brake testing procedures.

Optionally, the vehicle brake testing system 400 is configured to retrieve, through the RFID interrogator 20, data from the RFID transponder or tag 22 identifying the specific brake components of the vehicle. The retrieved data is utilized by the vehicle brake testing system 400 to check for any part recalls and to assist in diagnosing brake problems detected.

In addition to reading and utilizing data stored in an RFID transponder or tag 22 associated with a vehicle 24, the vehicle brake testing system 400 is optionally configured to modify the stored data on the RFID transponder or tag 22, or to add new data to the RFID transponder or tag 22. To add or modify data stored in an RFID transponder or tag 22, a software application operating in the computer 12 of the vehicle brake testing system 400 directs the RFID interrogator 20 to convey the new or modified data to the RFID transponder or tag 22, over the wireless communications link, together with any required instructions for storage therein.

In an alternate embodiment, the improved automotive vehicle service system 10 of the present invention is configured as vehicle inspection system 500. During inspection, a vehicle 24 is driven into a vehicle inspection bay, and an operator utilizes one or more handheld data display and/or handheld data entry devices 502 such as a handheld personal digital assistant (PDA), or the operator utilizes one or more specialized sensors 504 such as an exhaust gas meter or temperature sensor, and carries out one or more predetermined inspections, such as, but not limited to, a suspension component check, an exhaust emissions check, a diagnostic readout, a brake check. The vehicle inspection system 500 is configured to receive input identifying the type of vehicle undergoing inspection, and to provide an operator with one or more desired operating parameters of the vehicle, such as permitted steering play, acceptable emission levels, and optionally, to identify to the operator one or more replacement parts should a defective component be identified.

The operation of the various components of a vehicle inspection system 500 and the one or more data display or data entry devices 502, described above, and the vehicle inspection system 500 in general, is well known to those of ordinary skill in the automotive service field. It should be understood that the above description is included for completeness only, and that various other automotive inspections systems could be used.

Operatively coupled to the computer 12 of the vehicle inspection system 500 is at least one RFID interrogator 20, having a reader/antenna 21, and configured to exchange data over a wireless communications link with one or more RFID transponders or tags 22, each having an antenna coil 23, and associated with a vehicle 24 or component 26 on the vehicle 24 undergoing an inspection procedure. Each RFID transponder or tag 22 advantageously requires no self-contained battery for operation. Instead, the RFID transponder or tag 22 obtains operating power from the radio frequency (RF) or electromagnetically coupled RFID interrogator 20 when in proximity thereto.

The computer 12 in the vehicle inspection system 500 is configured with a software application to communicate with or to control the RFID interrogator 20, and to extract stored data from the RFID transponders or tags 22 prior to, or during, an inspection procedure over the electromagnetic coupling or wireless communications link between the RFID interrogator antenna 21 and each RFID transponder or tag antenna coil 23. The vehicle inspection software application operating on the computer 12 of the vehicle inspection system 500 is configured to utilize the extracted data to facilitate the completion of one or more vehicle inspection procedures, to provide necessary data to an operator, or to facilitate the ordering of replacement components.

Preferably, the vehicle inspection system 500 is configured to identify, using data obtained from associated RFID transponders or tags 22, vehicle and/or component information. By using information obtained from the RFID transponders or tags 22, the vehicle inspection system 500 is configured to specifically identify which components are installed on a vehicle, and the correct inspection information (images, videos, technical service bulletins, proper inspection procedures, MAP procedures, etc.) to present to an operator. If an identified component is identified as defective during the inspection, the information obtained from an associated RFID transponder or tag 22 by the vehicle inspection system 500 can be used to either automatically order a replacement part, or provide an operator with the necessary ordering information.

Those of ordinary skill in the art will recognize that the RFID communication concepts disclosed herein may be utilized in a wide variety of aftermarket automotive service devices in addition to those specifically set forth herein without departing from the scope of the invention. Various aftermarket automotive service devices may include the RFID communication concepts disclosed herein for purposes of obtaining and storing information related to an automotive vehicle or vehicle component undergoing service. For example, a tire inflation system could use RFID communications to determine a manufacturer's recommended tire inflation pressure, or use RFID communications to identify installed suspension system components.

Each of the embodiments of the present invention can be embodied in-part in the form of computer-implemented processes and apparatuses for practicing those processes. The present invention can also be embodied in-part in the form of computer program code containing instructions embodied in tangible media, such as floppy diskettes, CD-ROMs, hard drives, or an other computer readable storage medium, wherein, when the computer program code is loaded into and executed by a computer, the computer becomes an apparatus for practicing the invention.

Each of the embodiments of the present invention can also be embodied in-part in the form of computer program code, for example, whether stored in a storage medium, loaded into and/or executed by a computer, or transmitted over some transmission medium, such as over electrical wiring or cabling, through fiber optics, or via electromagentic radiation, wherein, when the computer program code is loaded into and executed by a computer, the computer becomes an apparatus for practicing the invention. When implemented in a general-purpose microprocessor, the computer program code segments configure the microprocessor to create specific logic circuits.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. An improved automotive service system having a computer configured with at least one software application to carry out one or more vehicle service procedures, one or more input devices operatively coupled to the computer, one or more display devices operatively coupled to the computer, and one or more vehicle service devices coupled to the computer, the improvement comprising:

at least one RFID interrogator operatively coupled to the computer, said RFID interrogator including an antenna configured to receive data over a wireless communications link with one or more RFID transponders;

wherein the computer is further configured to control said RFID interrogator; and wherein the computer is further configured to utilize said RFID interrogator to retrieve stored data from the one or more RFID transponders to facilitate the completion of one or more vehicle service procedures.

2. The improved automotive service system of claim 1 wherein said RFID interrogator is further configured to transmit data over said wireless communications link to one or more RFID transponders; and wherein the computer is further configured with the software application to utilize said RFID interrogator to communicate data to said one or more RFID transponders for storage therein.

3. The improved automotive service system of claim 2 wherein said communicated data is representative of at least one value from the set of: measured tire imbalances, measured alignment values, measured brake system values, vehicle service history, tire pressure, vehicle mileage, tire mileage, chronological values, and component installation parameters.

4. The improved automotive service system of claim 1 wherein said one or more vehicle service devices coupled to the computer include a rotating spindle configured to receive a vehicle wheel assembly including said one or more RFID transponders, and at least one imbalance sensor configured to detect imbalance forces from a rotating vehicle wheel assembly mounted on said rotating spindle;

wherein the computer is configured with at least one software application to carry out one or more vehicle wheel balancing procedures.

5. The improved automotive service system of claim 1 wherein the computer is configured with at least one software application to carry out one or more vehicle wheel alignment procedures; and wherein said one or more vehicle service devices operatively coupled to the computer include at least one vehicle wheel alignment sensor assembly.

6. The improved automotive service system of claim 5 wherein said at least one RFID interrogator is disposed within said at least one vehicle wheel alignment sensor assembly.

7. The improved automotive service system of claim 5 further including a plurality of vehicle wheel alignment sensor assemblies, and a plurality of RFID interrogators, each of said plurality of RFID interrogators disposed within an associated vehicle wheel alignment sensor assembly.

8. The improved automotive service system of claim 1 wherein said one or more vehicle service devices include a tire clamping system and a bead roller assembly; and wherein the computer is configured with at least one software application to carry out one or more automotive tire changing procedures utilizing said tire clamping system and said bead roller assembly.

9. The improved automotive service system of claim 1 wherein said one or more vehicle service devices include a brake force testing unit; and wherein the computer is configured with at least one software application to carry out one or more vehicle brake testing procedures utilizing said brake force testing unit.

10. The improved automotive service system of claim 1, configured as a vehicle inspection system, wherein said one or more vehicle service devices include at least one of the set of a handheld data display, a handheld data entry device, and a specialized sensor; and wherein the computer is configured with at least one software application to carry out one or more vehicle inspection procedures utilizing said one or more vehicle service devices.

11. The improved automotive service system of claim 1 wherein said stored data is in a predetermined format.

12. The improved automotive service system of claim 11 wherein said predetermined format is the AIAG B-11 standard.

13. The improved automotive service system of claim 1 wherein said stored data is representative of at least one value from the set of: tire conicity, tire radial force, tire radial harmonic force, tire lateral force, tire lateral harmonic force, tire static imbalance, tire harmonic location, tire dynamic imbalance, tire runout, tire pressure, tire dimensions, tire manufacture data, tire test data, and wheel rim dimensions.

14. The improved automotive service system of claim 1 wherein said stored data is representative of at least one value from the set of: wheel alignment specifications, vehicle specifications, vehicle identifications, vehicle service history, and actual alignment values.

15. The improved automotive service system of claim 1 wherein said stored data is representative of at least one value from the set of: component specifications, component identifications, and component installation parameters.

16. The improved automotive service system of claim 1 wherein the computer is configured with at least one software application to carry out one or more vehicle inspections; and wherein the computer is further configured to utilize the RFID interrogator to retrieve stored data from one or more RFID transponders to facilitate the completion of one or more vehicle inspection procedures.

17. The improved automotive service system of claim 16 wherein the computer is further configured to utilize the RFID interrogator to retrieve stored data from one or more RFID transponders to facilitate the ordering of one or more vehicle components.

18. The improved automotive service system of claim 1 wherein said at least one RFID interrogator is operatively coupled to the computer via a wireless communications link.

19. An improved method for servicing an automotive vehicle utilizing an automotive service system having a computer configured with at least one software application to carry out one or more vehicle service procedures, one or more input devices operatively coupled to the computer, one or more display devices operatively coupled to the computer, one or more vehicle service devices coupled to the computer, and at least one RFID interrogator operatively coupled to the computer, the RFID interrogator including an antenna configured to receive data over a wireless communications link with one or more RFID transponders, comprising the steps of:

utilizing the RFID interrogator to retrieve stored data from one or more RFID transponders in proximity to the automotive service system; and utilizing the retrieved stored data to facilitate the completion of one or more automotive service procedures.

20. The improved method of claim 19 for servicing an automotive vehicle further including the step of:

substituting said retrieved stored data for one or more measured values associated with said one or more automotive service procedures.

21. The improved method of claim 19 for servicing an automotive vehicle further including the step of:

substituting said retrieved stored data for one or more specification values associated with said one or more automotive service procedures.

22. The improved method of claim 19 for servicing an automotive vehicle wherein the step of utilizing the retrieved stored data includes displaying said retrieved stored data on the one or more display devices.

23. The improved method of claim 19 for servicing an automotive vehicle wherein said retrieved stored data is utilized to facilitate the completion of one or more wheel assembly servicing procedures.

24. The improved method of claim 23 for servicing an automotive vehicle wherein said one or more wheel assembly servicing procedures include at least one wheel balancing procedure.

25. The improved method of claim 23 for servicing an automotive vehicle wherein said one or more wheel assembly servicing procedures include at least one wheel force measurement procedure.

26. The improved method of claim 19 for servicing an automotive vehicle wherein said retrieved stored data is utilized to facilitate the completion of one or more vehicle wheel alignment procedures.

27. The improved method of claim 19 for servicing an automotive vehicle wherein said retrieved stored data is utilized to facilitate the completion of one or more tire changing procedures.

28. The improved method of claim 19 for servicing an automotive vehicle wherein said retrieved stored data is utilized to facilitate the completion of one or more vehicle brake testing procedures.

29. The improved method of claim 19 for servicing an automotive vehicle wherein said retrieved stored data is utilized to facilitate the completion of one or more vehicle inspection procedures.

30. The improved method of claim 19 for servicing an automotive vehicle wherein the antenna is further configured to transmit data over the wireless communications link with the one or more RFID transponders, further comprising the steps of:

utilizing the RFID interrogator to communicate data to at least one RFID transponder in proximity to the automotive service system; and storing the communicated data within the at least one RFID transponder.

31. The improved method of claim 30 for servicing an automotive vehicle further including the step of supplementing, within the at least one RFID transponder, said stored data with said communicated data.

32. The improved method of claim 30 for servicing an automotive vehicle further including the step of replacing, within the at least one RFID transponder, at least a portion of said stored data with said communicated data.

33. An improved automotive service system having a computer, one or more input devices operatively coupled to the computer, one or more display devices operatively coupled to the computer, and one or more vehicle service devices coupled to the computer, the improvement comprising:

at least one RFID interrogator configured to exchange data with said computer, said RFID interrogator adapted to retrieve, over a wireless communications link, stored data from one or more RFID transponders; and wherein the computer is configured to utilize stored data from said RFID interrogator to facilitate the completion of one or more vehicle service procedures.

34. The improved automotive service system of claim 33 wherein said at least one RFID interrogator is configured to exchange data with said computer over a wireless communications link.

35. The improved automotive service system of claim 33 wherein said at least one RFID interrogator is disposed within a portable housing adapted for handheld operation.

36. The improved automotive service system of claim 33 wherein said at least one RFID interrogator is further configured to transmit, over a wireless communications link, data for storage at one or more RFID transponders; and wherein the computer is further configured to convey said data for storage to said RFID interrogator.

37. An improved method for servicing an automotive vehicle utilizing an automotive service system having a computer, one or more input devices operatively coupled to the computer, one or more display devices operatively coupled to the computer, one or more vehicle service devices coupled to the computer, and at least one RFID interrogator operatively coupled to the computer, the RFID interrogator including an antenna configured to exchange data over a wireless communications link with one or more RFID transponders, comprising the steps of:

utilizing the RFID interrogator to retrieve data from one or more RFID transponders;

conveying the retrieved data from the RFID interrogator to the computer;and utilizing, in the computer, the retrieved data to facilitate the completion of one or more automotive service procedures.

38. The improved method for servicing an automotive vehicle of claim 37 further including the steps of:

conveying new data from the computer to the RFID interrogator;

utilizing the RFID interrogator to communicate said new data to at least one of said one or more RFID transponders; and storing said communicated new data in said at least one of said one or more RFID transponders.

* * * * *

UNITED STATES PATENT AND TRADEMARK OFFICE

CERTIFICATE OF CORRECTION

PATENT NO. : 6,822,582 B2 
DATED : November 23, 2004
INVENTOR(S) : David Voeller and Joel Clasquin It is certified that error appears in the above-identified patent and that said Letters Patent is hereby corrected as shown below:

Column 16,
Line 53, after the words "and to", and before the word "stored", insert the word -- extract- --.

Column 18,
Line 23, replace "P205165-16" with -- P205/65-16- --.

Signed and Sealed this

Eleventh Day of October, 2005

JON W. DUDAS
*Director of the United States Patent and Trademark Office*